US009815287B2

(12) United States Patent
Moriguchi et al.

(10) Patent No.: US 9,815,287 B2
(45) Date of Patent: Nov. 14, 2017

(54) LIQUID DISCHARGE HEAD AND LIQUID DISCHARGE APPARATUS

(71) Applicant: CANON KABUSHIKI KAISHA, Tokyo (JP)

(72) Inventors: Takuto Moriguchi, Kamakura (JP); Seiichiro Karita, Saitama (JP); Yumi Komamiya, Kawasaki (JP); Shingo Okushima, Kawasaki (JP); Kazuhiro Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/394,386

(22) Filed: Dec. 29, 2016

(65) Prior Publication Data

US 2017/0197422 A1 Jul. 13, 2017

(30) Foreign Application Priority Data

Jan. 8, 2016 (JP) ..... 2016-002946
Dec. 5, 2016 (JP) ..... 2016-236072

(51) Int. Cl.
*B41J 2/165* (2006.01)
*B41J 2/17* (2006.01)
(Continued)

(52) U.S. Cl.
CPC ..... *B41J 2/165* (2013.01); *B41J 2/1408* (2013.01); *B41J 2/14032* (2013.01);
(Continued)

(58) Field of Classification Search
CPC ..... B41J 2/165; B41J 2/17; B41J 2/18; B41J 2/14145; B41J 2/1408; B41J 2/14032
See application file for complete search history.

(56) References Cited

U.S. PATENT DOCUMENTS

2010/0238238 A1* 9/2010 Yamamoto ..... B41J 2/1404 347/85
2012/0026242 A1* 2/2012 Igarashi ..... B41J 2/175 347/33

(Continued)

FOREIGN PATENT DOCUMENTS

JP 2003505281 A 2/2003

*Primary Examiner* — Julian Huffman
(74) *Attorney, Agent, or Firm* — Canon U.S.A., Inc. IP Division

(57) ABSTRACT

A liquid discharge head includes a recording element board having a first face on which multiple recording elements are provided, and discharge orifices for the recording elements, where pressure chambers are formed for each recording element and liquid is discharged from discharge orifices. A liquid supply channel and a liquid recovery channel are provided in common to the plurality of recording elements, in a second face opposite to the recording element board from the first face. The pressure chambers are each made to communicate with the liquid supply channel and the liquid recovery channel by the supply ports and recovery ports respectively, and a flow from the liquid supply channel through the pressure chambers to the liquid recovery channel is generated. A composited flow resistance of the liquid recovery channel and recovery ports is greater than a composited flow resistance of the liquid supply channel and supply ports.

13 Claims, 29 Drawing Sheets

(51) Int. Cl.
*B41J 2/14* (2006.01)
*B41J 2/18* (2006.01)

(52) U.S. Cl.
CPC ..... *B41J 2/14145* (2013.01); *B41J 2/17* (2013.01); *B41J 2/18* (2013.01)

(56) References Cited

U.S. PATENT DOCUMENTS

2014/0118448 A1* 5/2014 Domae ..... B41J 2/18 347/89
2014/0146110 A1* 5/2014 Melde ..... B41J 2/19 347/65
2015/0283815 A1* 10/2015 Igarashi ..... B41J 2/175 347/85
2016/0052259 A1* 2/2016 Sugitani ..... B41J 2/18 347/17
2016/0375682 A1* 12/2016 Matsuda ..... B41J 2/04581 347/10
2017/0096015 A1* 4/2017 Odaka ..... B41J 2/18
2017/0197413 A1* 7/2017 Nakagawa ..... B41J 2/14032

* cited by examiner

LIQUID DISCHARGE HEAD AND LIQUID DISCHARGE APPARATUS

BACKGROUND OF THE INVENTION

Field of the Invention

The present invention relates to a liquid discharge head and a liquid discharge apparatus that uses the liquid discharge head.

Description of the Related Art

A liquid discharge apparatus that records by discharging liquid onto a recording medium uses a liquid discharge head having a pressure chamber communicating with a discharge orifice and a recording element that provides energy for discharging to liquid within the pressure chamber. In inkjet recording apparatus, which is representative of liquid discharge apparatuses, discharges recording liquid from discharge orifices. The recording liquid is a color material such as dye or pigment contained in a medium. In a case where the liquid to be discharged is a recording liquid in such a liquid discharge apparatus for example, volatile components in the recording liquid near discharge orifices may evaporate, and the concentration of color material increase accordingly, leading to irregular color in the recorded image. There also are cases where the evaporation of the volatile components raises the viscosity of the liquid near the discharge orifices, which reduces the discharge speed of the liquid, and consequently the liquid cannot accurately reach the intended position on the recording medium. Evaporation of volatile components can also cause clogging of the discharge orifices and pressure chambers or the like.

One known measure to handle such an issue is to circulate liquid through the liquid discharge head, and particularly through the pressure chambers. For example, PCT Japanese Translation Patent Publication No. 2003-505281 discloses providing a discharge orifice and recording element for each pressure chamber, providing channels that branch from a common supply channel, pass through the pressure chambers, and merge at a common recovery channel, and to cause a great amount of recording liquid to flow over this channel.

Although the individual pressure chambers in the liquid discharge head 3 and the channels connecting thereto are relatively narrow, the configuration described in PCT Japanese Translation Patent Publication No. 2003-505281 causes a greater amount of liquid to flow through narrow channels than that discharged from the discharge orifices, resulting in increased pressure distribution (pressure drip) within the channels. If the variation in pressure distribution or pressure is great, variation will also occur in discharge properties from the discharge orifices, and quality of the recording formed on the recording medium will deteriorate. It is conceivable to flow the liquid to the pressure chambers at a small flow rate to avoid such deterioration in quality. However, if the amount of liquid circulating through the pressure chambers is reduced, there are cases where high-temperature liquid that has passed through the pressure chambers and flowed downstream will back up toward the pressure chambers if the amount of liquid being discharged from the discharge orifices by driving of the recording elements suddenly increases. This heat of the backflow liquid combined with the heat from driving the recording elements will make the temperature of the liquid near the discharge orifices even hotter. On the other hand, if a state where liquid is discharged from the discharge orifices continues, the liquid which has become hot as described above is gradually discharged, and is replaced by supply of cool liquid into the pressure chambers. As a result, the temperature of the liquid near the discharge orifices gradually returns to normal temperature. Thus, in an arrangement where the flow rate of the liquid circulating through the pressure chambers is small, the temperature of the liquid near the discharge orifices temporarily rises as the recording operations start, and thereafter return to a normal state. This temperature change may change the discharge speed or discharge amount of the liquid, and affect recording quality.

SUMMARY OF THE INVENTION

It has been found desirable to provide a liquid discharge head and a liquid discharge apparatus using the liquid discharge head, whereby liquid circulation to pressure chambers can be realized without causing variation in discharge properties, and suppress excessive rise in temperature due to backflow of hot liquid to the pressure chambers.

A liquid discharge head includes a recording element board having a first face on which a plurality of recording elements that generate energy to discharge liquid is provided, partitions disposed between adjacent recording elements, and discharge orifices disposed for each of the recording elements, facing the recording elements, where pressure chambers are formed by the partitions for each recording element and liquid within the pressure chambers is discharged from the discharge orifices by the recording elements. The liquid discharge head includes a liquid supply channel communicating with the plurality of pressure chambers and formed on a second face on the opposite face of the recording element board from the first face, a liquid recovery channel communicating with the plurality of pressure chambers and formed on the second face, supply ports communicating between the pressure chambers and the liquid supply channel, and recovery ports communicating between the pressure chambers and the liquid recovery channel. A flow is formed from the liquid supply channel through the supply ports, pressure chambers, recovery ports, and liquid recovery channel, in a standby state where liquid is not being discharged. A composited flow resistance of the liquid recovery channel and recovery ports is greater than a composited flow resistance of the liquid supply channel and supply ports.

The liquid discharge apparatus according to the present invention includes the liquid discharge head according to the present invention, a storage unit storing liquid, a first circulation system that circulates liquid from the storage unit, and a second circulation system that circulates liquid from the storage unit using a lower pressure than the first circulation system. The liquid supply channel communicates with the first circulation system, and the liquid recovery channel communicates with the second circulation system.

Further features of the present invention will become apparent from the following description of exemplary embodiments with reference to the attached drawings.

DESCRIPTION OF THE EMBODIMENTS

Figure 1:
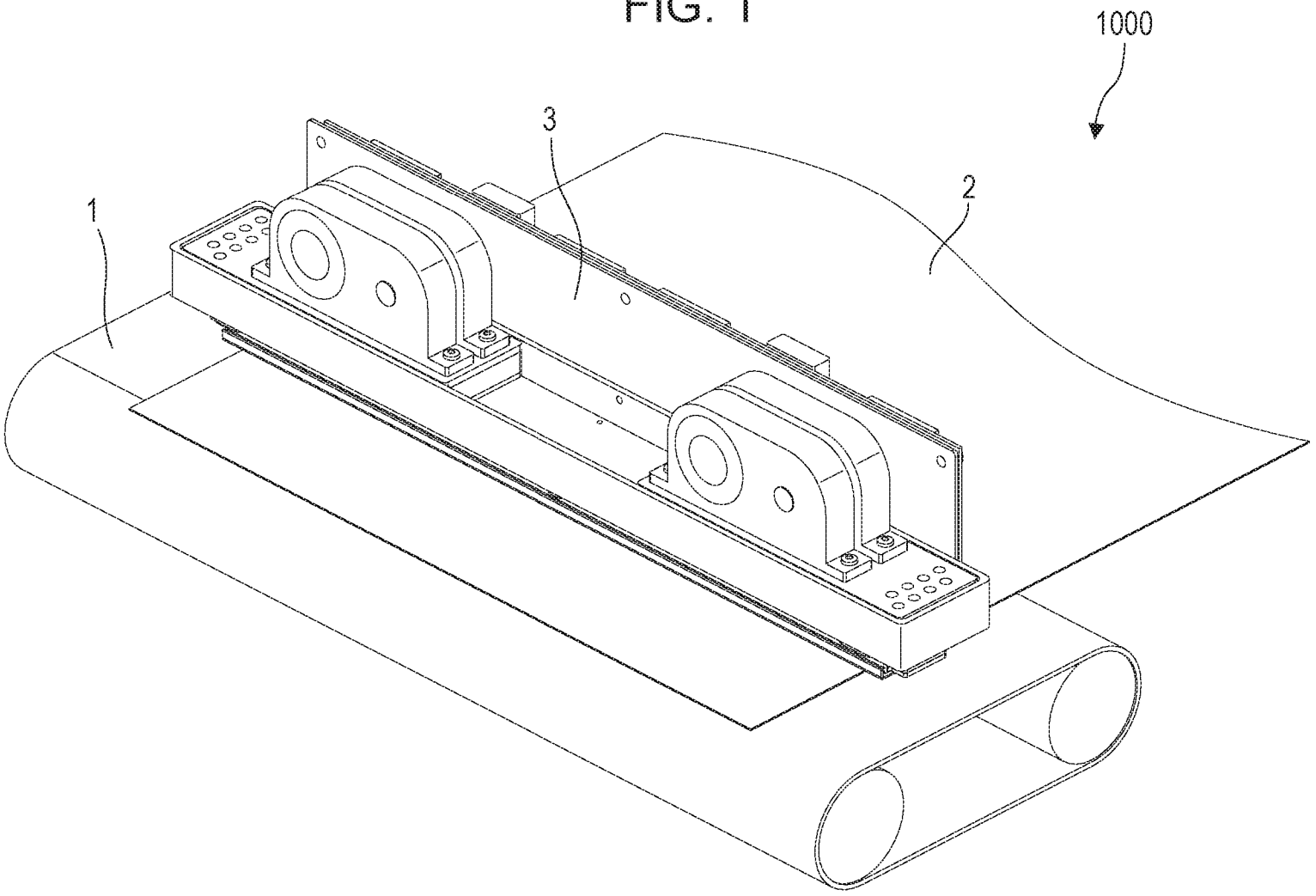
FIG. 1 is a diagram illustrating a schematic configuration of a liquid discharge apparatus according to a first configuration example.

Configuration examples, embodiments, and examples to which the present invention is applicable will be described below with reference to the drawings. It should be understood that the description that follows does not restrict the scope of the present invention. As one example, an example of a so-called thermal system liquid discharge head, that discharges liquid from a discharge orifice by generating bubbles by heat in liquid in a pressure chamber, using a heat-generating element as a recording element that generates energy to discharge liquid, will be described below. However, liquid discharge heads to which the present invention can be applied is not restricted to thermal systems, and the present invention can be applied to liquid discharge heads employing the piezoelectric system using piezoelectric elements, and various other types of liquid discharge systems. The liquid discharge head according to the present invention that discharges liquid such as ink, and the liquid discharge apparatus having the liquid discharge head, are applicable to apparatuses such as printers, photocopiers, facsimile devices having communication systems, word processors having printer units, and so forth, and further to industrial recording apparatuses combined in a complex manner with various types of processing devices. For example, the present invention can be used in fabricating biochips, printing electronic circuits, fabricating semiconductor substrates, and other such usages.

Although the description below relates to a liquid discharge head 3 used in a liquid discharge apparatus where a liquid such as recording liquid or the like is circulated between a tank and liquid discharge head, The liquid discharge apparatus using the liquid discharge head according to the present invention is not restricted to this. The present invention may be applied to an arrangement of a liquid discharge apparatus where, instead of circulating liquid, two tanks are provided, one at the upstream side of the liquid discharge head and the other on the downstream side, and liquid within the pressure chamber of the liquid discharge head is caused to flow by running liquid from one tank to the other via the liquid discharge head.

Also, the description below relates to a so-called line head that has a length corresponding to the width of the recording medium, but the present invention can also be applied to a so-called serial liquid discharge head that completes recording on a recording medium by scanning in a main scan direction and sub-scan direction. An example of a serial liquid discharge head is one that has one recording element board each for recording black recording liquid and for recording color recording liquid, but this is not restrictive. An example of a serial liquid discharge head may be an arrangement where short line heads that are shorter than the width of the recording medium are formed, with multiple recording element boards arrayed so that orifices overlap in the discharge orifice row direction, and these being scanned over the recording medium.

Figure 2:
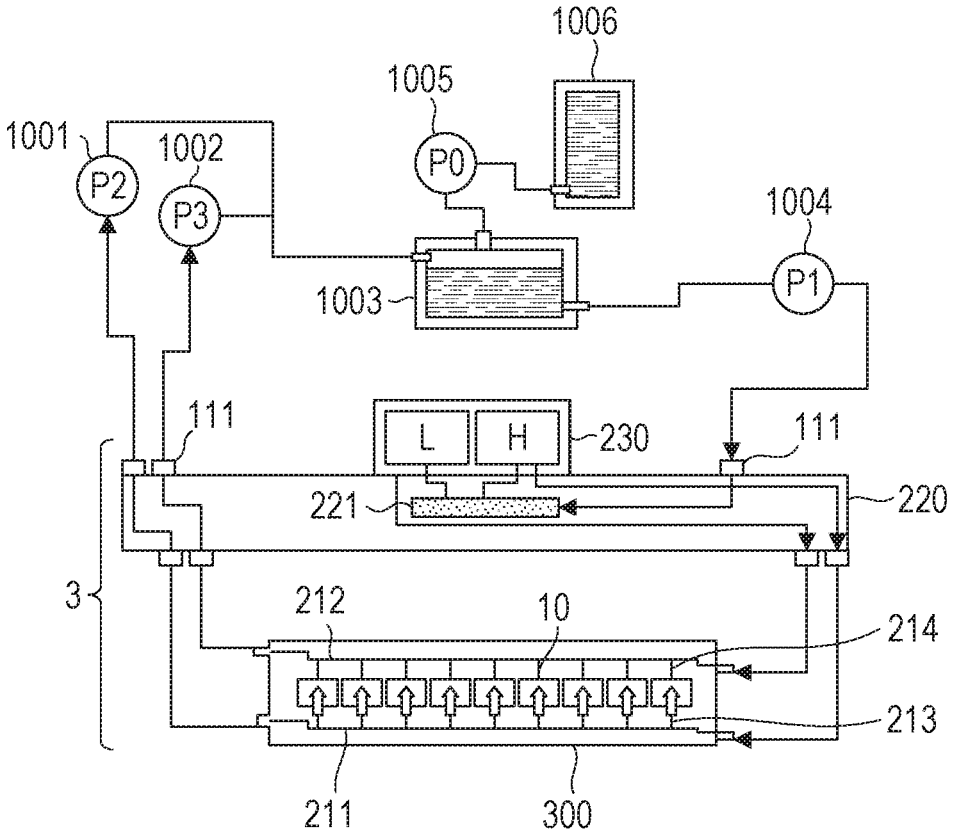
FIG. 2 is a diagram illustrating a first circulation arrangement.

Description of Liquid Discharge Head Apparatus According to First Configuration Example First, description will be made regarding an inkjet recording apparatus 1000 (hereinafter also referred to simply as "recording apparatus") that performs recording by discharging a recording liquid as liquid from discharge orifices onto a recording medium, as an example of a liquid discharge apparatus according to the present invention. FIG. 1 illustrates a schematic configuration of the recording apparatus 1000 as a liquid discharge apparatus according to a first configuration example. The recording apparatus 1000 has a conveyance unit 1 that conveys a recording medium 2, and a line type liquid discharge head 3 disposed generally orthogonal to the conveyance direction of the recording medium 2, and is a line type recording apparatus that performs single-pass continuous recording while continuously or intermittently conveying multiple recording mediums 2. The recording medium 2 is not restricted to cut sheets, and may be continuous roll sheets. The liquid discharge head 3 is capable of full-color printing by cyan (C), magenta (M), yellow (Y), and black (K) color recording liquid (these colors are also referred together as CMYK). The liquid discharge head 3 is connected by fluid connection to a liquid supply arrangement that is a supply path for supplying liquid to the liquid discharge head 3, a main tank, and a buffer tank (see FIG. 2), as described later. The liquid discharge head 3 can be roughly divided into a liquid supply unit 220, a negative pressure control unit 230, and a liquid discharge unit 300, as illustrated in FIG. 2 which will be described later. Multiple recording element boards 10, and a common supply channel 211 and common recovery channel 212 are provided to the liquid discharge unit 300, with multiple recording elements provided to each of the recording element boards 10. In the liquid discharge unit 300, the recording liquid is supplied from the common supply channel 211 to the recording element boards 10 as indicated by arrows in FIG. 2, and this recording liquid is recovered by the common recovery channel 212. The liquid discharge head 3 is also electrically connected to an electric control unit that transmits electric power and discharge control signals to the liquid discharge head 3. Liquid paths and electric signal paths within the discharge head 3 will be described in detail later.

Description of First Circulation Arrangement

FIG. 2 illustrates a first circulation arrangement that is a form of a circulation path configuration applied to the liquid discharge apparatus according to the present invention. In the first circulation arrangement, the liquid discharge head 3 is connected to a high-pressure side first circulation pump 1001, a low-pressure side first circulation pump 1002, and a buffer tank 1003 and the like by fluid connection. Although FIG. 2 only illustrates the paths over which one color recording liquid flows, out of the recording liquids of each of the CMYK colors, for the sake of brevity of description, in reality four colors worth of circulation paths are provided to the liquid discharge head 3 and the recording apparatus main unit. The buffer tank 1003, serving as a sub-tank that is connected to a main tank 1006, has an atmosphere communication opening (omitted from illustration) whereby the inside and the outside of the tank communicate, and bubbles within the recording liquid can be discharged externally. The buffer tank 1003 is also connected to a replenishing pump 1005. When liquid is consumed at the liquid discharge head 3, by discharging (ejecting) recording liquid from the discharge orifices of the liquid discharge head 3, to perform recording, suction recovery, or the like, for example, the replenishing pump 1005 acts to transfer recording liquid of an amount the same as that has been consumed from the main tank 1006 to the buffer tank 1003.

The two first circulation pumps 1001 and 1002 serving as a liquid transfer unit act to extract liquid from a fluid connector 111 of the liquid discharge head 3 and flow the liquid to the buffer tank 1003. The first circulation pumps 1001 and 1002 preferably are positive-displacement pumps that have quantitative fluid sending capabilities. Specific examples may include tube pumps, gear pumps, diaphragm pumps, syringe pumps, and so forth. An arrangement may also be used where a constant flow is ensured by disposing a common-use constant-flow valve and relief valve at the outlet of the pump, for example. When the liquid discharge unit 300 is being driven, the high-pressure side first circulation pump 1001 and low-pressure side first circulation pump 1002 each cause a constant amount of recording liquid to flow through a common supply channel 211 and a common recovery channel 212. The amount of flow is preferably set to a level where temperature difference among recording element boards 10 of the liquid discharge head 3 does not influence recording image quality on the recording medium 2, or higher. On the other hand, if the flow rate is set excessively high, the effects of pressure drop in the channels within a liquid discharge unit 300 causes excessively large difference in negative pressure among the recording element boards 10, resulting in unevenness in density in the recorded image. Accordingly, the flow rate is preferably set taking into consideration temperature difference and negative pressure difference among the recording element boards 10. Of the paths that the recording liquid circulate over, the path including the high-pressure side first circulation pump 1001 makes up a first circulation system in the liquid discharge apparatus, and the path including the low-pressure side first circulation pump 1002 makes up a second circulation system in the liquid discharge apparatus.

A second circulation pump 1004 is provided on the path supplying recording liquid from the buffer tank 1003 toward the liquid discharge head 3. The negative pressure control unit 230 is disposed on the path between the second circulation pump 1004 and the liquid discharge unit 300. The negative pressure control unit 230 functions such that the pressure downstream from the negative pressure control unit 230 (i.e., at the liquid discharge unit 300 side) can be maintained at a present constant pressure even in cases where the flow rate of the circulation system fluctuates due to difference in duty when recording. The negative pressure control unit 230 has two pressure adjustment mechanisms each set to different control pressures. Any mechanism may be used as these two pressure adjustment mechanisms, as long as pressure downstream from itself can be controlled to fluctuation within a constant range or smaller that is centered on a desired set pressure. As one example, a mechanism equivalent to a so-called "pressure-reducing regulator" can be employed. In a case of using a pressure-reducing regulator as a pressure adjustment mechanism, the upstream side of the negative pressure control unit 230 is preferably pressurized by the second circulation pump 1004 via a liquid supply unit 220, as illustrated in FIG. 2. This enables the effects of water head pressure as to the liquid discharge head 3 of the buffer tank 1003 to be suppressed, giving broader freedom in the layout of the buffer tank 1003 in the recording apparatus 1000. It is sufficient that the second circulation pump 1004 have a certain lift pressure or greater, within the range of the circulatory flow rate of recording liquid used when driving the liquid discharge head 3, and turbo pumps, positive-displacement pumps, and the like can be used. Specifically, diaphragm pumps or the like can be used. Alternatively, a water head tank disposed with a certain water head difference as to the negative pressure control unit 230, for example, may be used instead of the second circulation pump 1004.

Of the two pressure adjustment mechanisms in the negative pressure control unit 230, the relatively high-pressure setting side pressure adjustment mechanism (denoted by H in FIG. 2) is connected to the common supply channel 211 within the liquid discharge unit 300 via the liquid supply unit 220. In the same way, the relatively low-pressure setting side pressure adjustment mechanism (denoted by L in FIG. 2) is connected to the common recovery channel 212 within the liquid discharge unit 300 via the liquid supply unit 220. Provided to the liquid discharge unit 300, besides the common supply channel 211 and common recovery channel 212, are individual supply channels 213 and individual recovery channels 214 each communicating with the recording element boards 10. The individual supply channels 213 and individual recovery channels 214 provided to each recording element board are collectively referred to as "individual channels". The individual channels are provided branching from the common supply channel 211 and merging at the common recovery channel 212, and communicating therewith. Accordingly, flows occur where part of the liquid such as recording liquid flows from the common supply channel 211 through inside of the recording element boards 10 and to the common recovery channel 212 (indicated by the outline arrows in FIG. 2). The reason is that the high-pressure side pressure adjustment mechanism H is connected to the common supply channel 211, and the low-pressure side pressure adjustment mechanism L to the common recovery channel 212, so a pressure difference is generated between the two common channels.

Thus, flows occur within the liquid discharge unit 300 where a part of the liquid passes through the recording element boards 10 while liquid flows through each of the common supply channel 211 and common recovery channel 212. Accordingly, heat generated at the recording element boards 10 can be externally discharged from the recording element boards 10 by the flows through the common supply channel 211 and common recovery channel 212. This configuration also enables recording liquid flows to be generated at discharge orifices and pressure chambers not being used for recording while recording is being performed by the liquid discharge head 3, so higher viscosity of the recording liquid due to evaporation of the medium component of the recording liquid at such portions can be suppressed. Also, thickened recording liquid and foreign substance in the recording liquid can be expelled to the common recovery channel 212. Accordingly, using the above-described liquid discharge head 3 enables recording to be performed at high speed with high image quality.

Description of Second Circulation Arrangement

Figure 3:
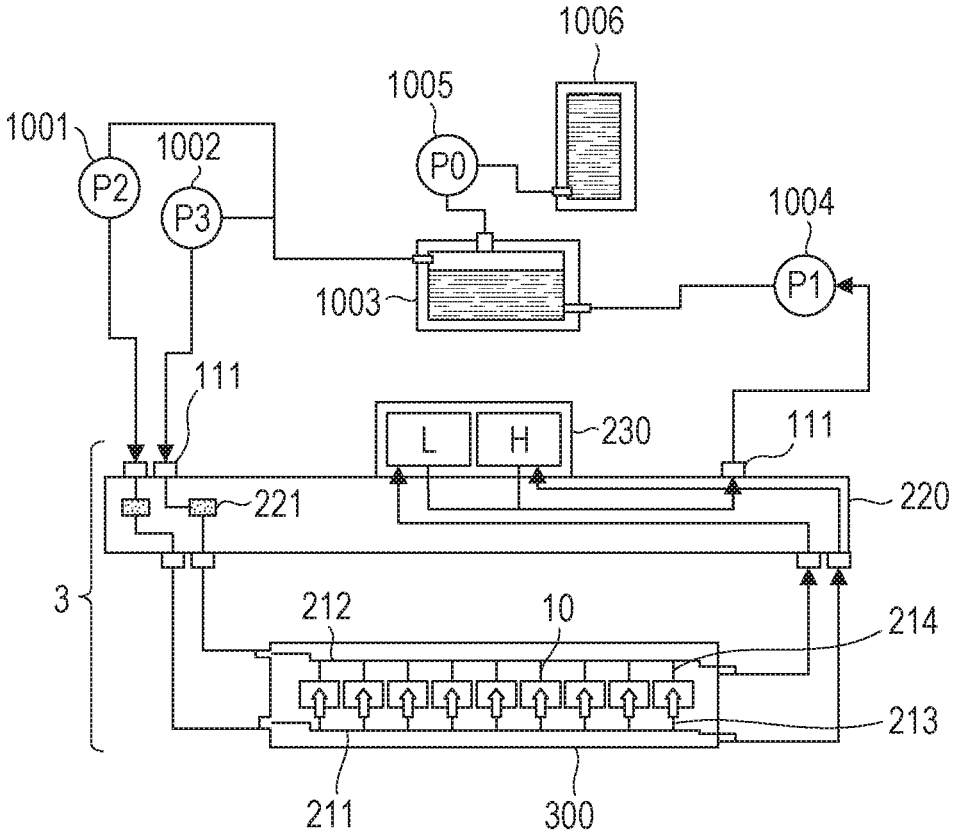
FIG. 3 is a diagram illustrating a second circulation arrangement.

FIG. 3 is a schematic diagram illustrating, of circulation arrangement configurations applied to the liquid discharge apparatus according to the present invention, a second circulation arrangement that is a different circulation arrangement from the above-described first circulation arrangement. The primary points of difference of the second circulation arrangement as to the above-described first circulation arrangement are that both of the two pressure adjustment mechanisms making up the negative pressure control unit 230 are a mechanism to control pressure at the upstream side from the negative pressure control unit 230 to fluctuation within a constant range that is centered on a desired set pressure. This sort of pressure adjustment mechanism can be configured as a mechanism part having operations the same as a so-called "backpressure regulator". The second circulation pump 1004 acts as a negative pressure source to depressurize the downstream side from the negative pressure control unit 230, and the high-pressure side first circulation pump 1001 and low-pressure side first circulation pump 1002 are disposed on the upstream side of the liquid discharge head 3. Accordingly, the negative pressure control unit 230 is disposed on the downstream side of the liquid discharge head 3.

The negative pressure control unit 230 according to the second circulation arrangement acts to maintain pressure fluctuation on the upstream side of itself within a constant range centered on a preset pressure, even in cases where the flow rate fluctuates due to difference in recording duty when recording with the liquid discharge head 3. The upstream side of the negative pressure control unit 230 here is the liquid discharge unit 300 side. The downstream side of the negative pressure control unit 230 is preferably pressurized by the second circulation pump 1004 via the liquid supply unit 220, as illustrated in FIG. 3. This enables the effects of water head pressure of the buffer tank 1003 as to the liquid discharge head 3 to be suppressed, giving a broader range of selection for the layout of the buffer tank 1003 in the recording apparatus 1000. Alternatively, a water head tank disposed with a certain water head difference as to the negative pressure control unit 230, for example, may be used instead of the second circulation pump 1004.

The negative pressure control unit 230 illustrated in FIG. 3 has two pressure adjustment mechanisms, with different control pressure from each other having been set, in the same way as the first circulation arrangement. The high-pressure setting side (denoted by H in FIG. 3) and the low-pressure setting side (denoted by L in FIG. 3) pressure adjustment mechanisms are respectively connected to the common supply channel 211 and the common recovery channel 212 within the liquid discharge unit 300 via the liquid supply unit 220. The pressure of the common supply channel 211 is made to be relatively higher than the pressure of the common recovery channel 212 by the two pressure adjustment mechanisms, whereby flows occur where recording liquid flows from the common supply channel 211 through the individual channels and internal channels in the recording element board 10 to the common recovery channel 212. The flows of recording liquid in FIG. 3 are indicated by outline arrows. The second circulation arrangement thus yields a recording liquid flow state the same as that of the first circulation arrangement within the liquid discharge unit 300, but has two advantages that are different from the case of the first circulation arrangement.

One advantage is that, with the second circulation arrangement, the negative pressure control unit 230 is disposed on the downstream side of the liquid discharge head 3, so there is little danger that dust and foreign substances generated at the negative pressure control unit 230 will flow into the liquid discharge head 3.

A second advantage is that the maximum value of the necessary flow rate supplied from the buffer tank 1003 to the liquid discharge head 3 can be smaller in the second circulation path as compared to the case of the first circulation arrangement. The reason is as follows. The total flow rate within the common supply channel 211 and common recovery channel 212 when circulating during recording standby will be represented by A. The value of A is defined as the smallest flow rate necessary to maintain the temperature difference in the liquid discharge unit 300 within a desired range in a case where temperature adjustment of the liquid discharge head 3 is performed during recording standby. Also, the discharge flow rate in a case of discharging recording liquid from all discharge orifices of the liquid discharge unit 300 (full discharge) is defined as F. Accordingly, in the case of the first circulation arrangement (FIG. 2), the set flow rate of the first circulation pump (high-pressure side) 1001 and the first circulation pump (low-pressure side) 1002 is A, so the maximum value of the liquid supply amount to the liquid discharge head 3 necessary for full discharge is A+F. On the other hand, in the case of the second circulation arrangement in FIG. 3, the liquid supply amount to the liquid discharge head 3 necessary at the time of recording standby is flow rate A. This means that the supply amount to the liquid discharge head 3 necessary for full discharge is flow rate F. Accordingly, in the case of the second circulation arrangement, the total value of the set flow rate of the high-pressure side and low-pressure side first circulation pumps 1001 and 1002, i.e., the maximum value of the necessary supply amount, is the larger value of A and F. Thus, the maximum value of the necessary supply amount in the second circulation arrangement (A or F) is always smaller than the maximum value of the necessary supply amount in the first circulation arrangement (A+F), as long as the liquid discharge unit 300 of the same configuration is used. Consequently, the degree of freedom regarding circulatory pumps that can be applied is higher in the case of the second circulation arrangement, and low-cost circulatory pumps having simple structure can be used, the load on a cooler (omitted from illustration) disposed on the main unit side path can be reduced, thereby reducing costs of the recording apparatus main unit. This advantage is more pronounced with line heads where the values of A or F are relatively great, and is more useful the longer the length of the line head is in the longitudinal direction.

However, on the other hand, there are points where the first circulation arrangement is more advantageous than the second circulation arrangement. With the second circulation arrangement, the flow rate flowing through the liquid discharge unit 300 at the time of recording standby is maximum, so the lower the recording duty of the image is, the greater a negative pressure is applied to the nozzles. Accordingly, particularly in a case where the channel widths of the common supply channel 211 and common recovery channel 212 is reduced to reduce the head width, high negative pressure may be applied to the nozzles in low-duty images where unevenness is easy to see, which may increase the influence of satellite droplets. Note that the channel width of the common supply channel 211 and common recovery channel 212 is the length in the direction orthogonal to the direction of low of liquid, and the head width is the length in the transverse direction of the liquid discharge head 3. On the other hand, high pressure is applied to the nozzles when forming high-duty images in the case of the first circulation arrangement, so any generated satellite droplets are less conspicuous in the recorded image, which is advantageous in that influence on the image quality is small. Which of these two circulation arrangements is more preferable can be selected in light of the specifications of the liquid discharge head 3 and recording apparatus main unit (discharge flow rate F, smallest circulatory flow rate A, and channel resistance within the liquid discharge head 3).

Description of Configuration of Liquid Discharge Head

Figure 4A:
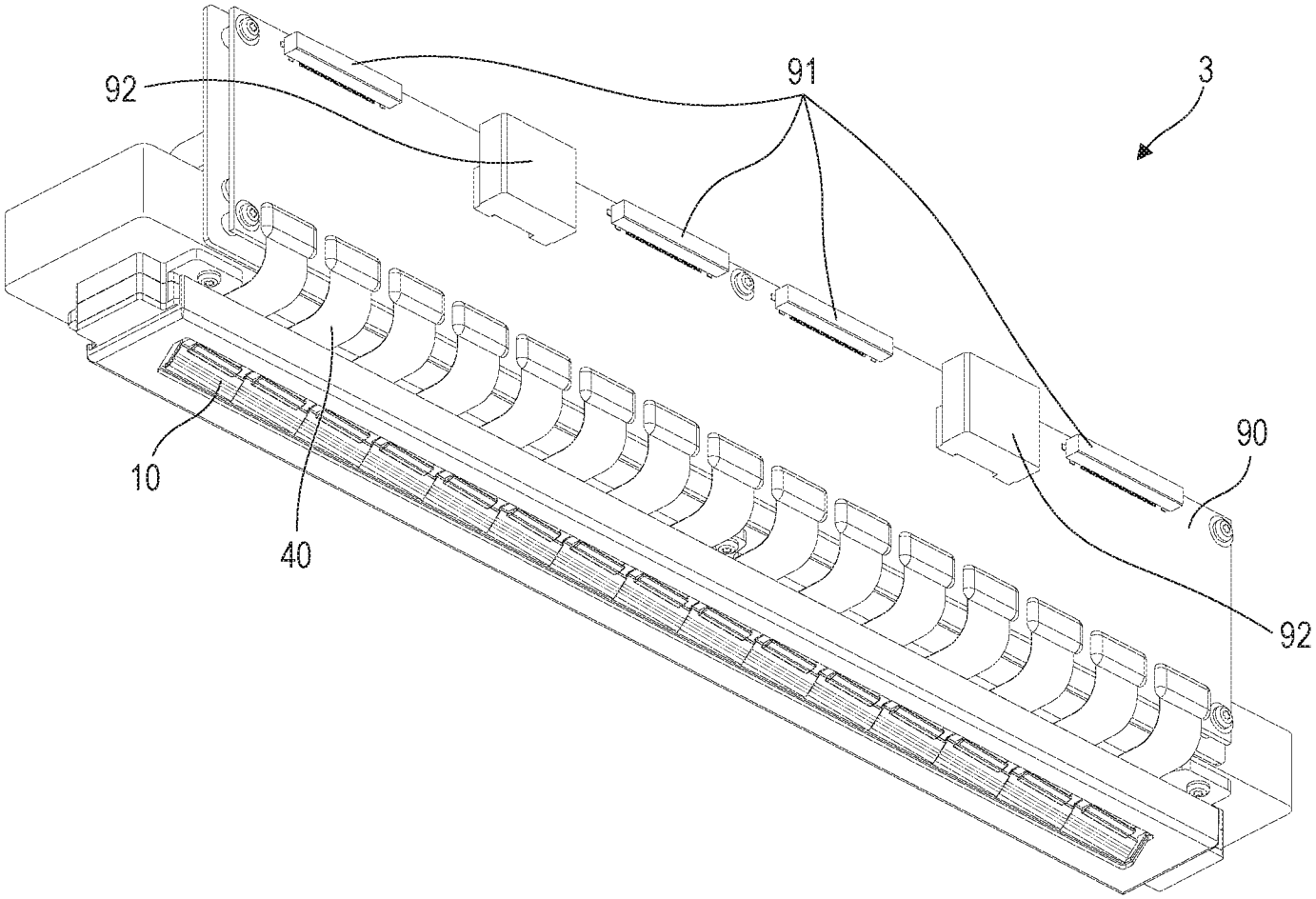
FIGS. 4A and 4B are perspective diagrams illustrating the configuration of a liquid discharge head.
Figure 4B:
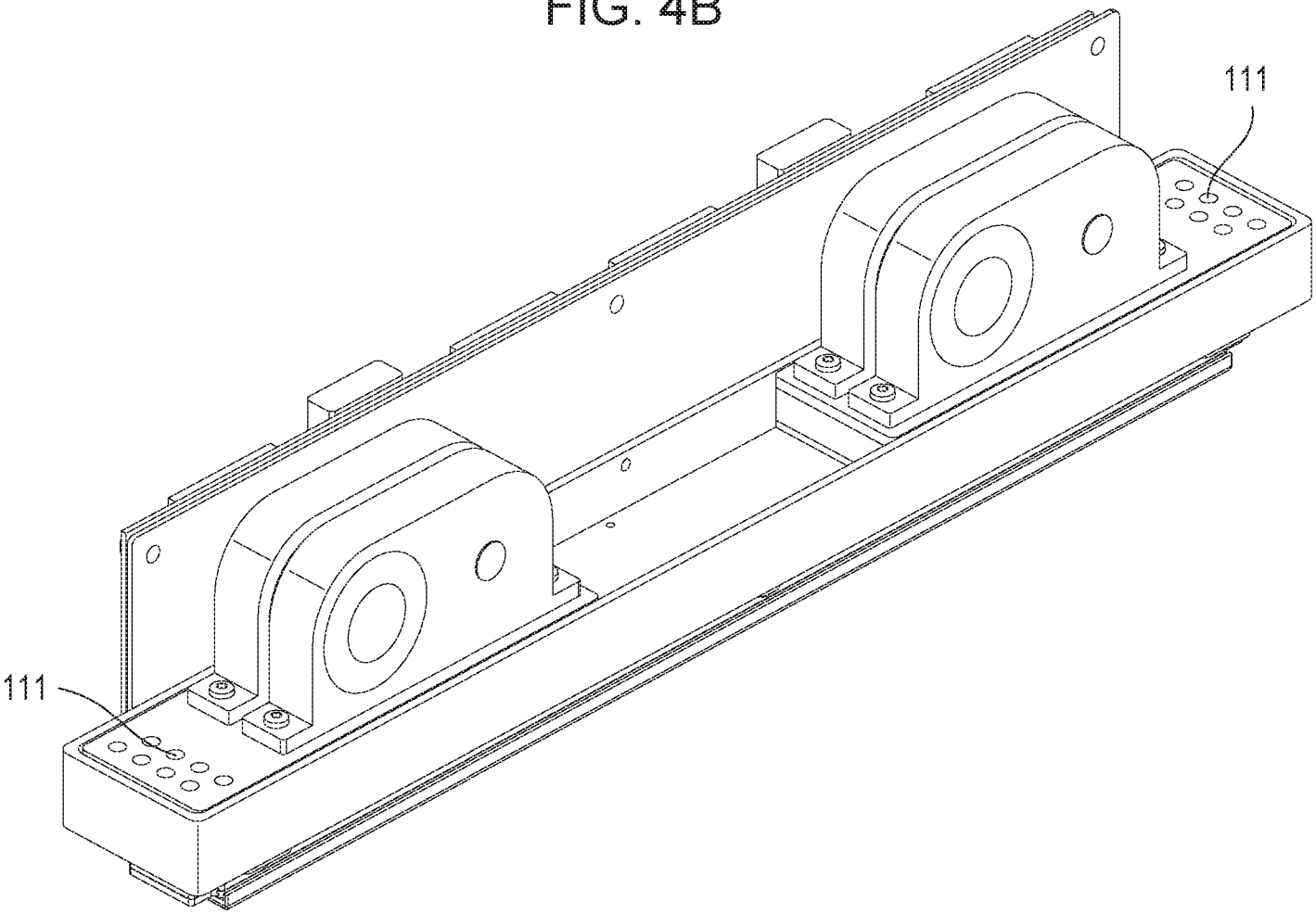

The configuration of the liquid discharge head 3 will be described next with reference to FIGS. 4A and 4B. FIG. 4A is a perspective view of the liquid discharge head 3 as viewed from the side of the face where the discharge orifices 13 are formed, and FIG. 4B is a perspective view from the opposite side from FIG. 4A. The liquid discharge head 3 is a line-type liquid discharge head where fifteen recording element boards 10 capable of discharging recording liquid of the four colors of cyan (C), magenta (M), yellow (Y), and black (K) are arrayed on a straight line (inline layout). The liquid discharge head 3 includes 15 recording element boards 10, flexible printed circuit boards 40, and an electric wiring board 90, as illustrated in FIG. 4A. The electric wiring board 90 is provided with input terminals 91 and power supply terminals 92, the input terminals 91 and power supply terminals 92 being electrically connected to the recording element boards 10 via the electric wiring board 90 and flexible printed circuit boards 40. The input terminals 91 and power supply terminals 92 are electrically connected to a control circuit of the recording apparatus 1000, and respectively supply discharge drive signals and electric power necessary for discharging to the recording element boards 10. Consolidating the wiring by electric circuits in the electric wiring board 90 enables the number of the input terminals 91 and power supply terminals 92 to be reduced as compared with the number of recording element boards 10. This enables reducing the number of electric connection portions that need to be removed when assembling the liquid discharge head 3 to the recording apparatus 1000 or when exchanging the liquid discharge head 3. Liquid connection portions 111 provided to both ends of the liquid discharge head 3 are connected with the liquid supply system of the recording apparatus 1000, as illustrated in FIG. 4B. Thus, recording liquid of the four colors of CMYK is supplied form the supply system of the recording apparatus 1000 to the liquid discharge head 3, and recording liquid that has passed through the liquid discharge head 3 is recovered to the supply system of the recording apparatus 1000 such as illustrated in FIG. 2 or 3. In this way, recording liquid of each color can circulate over the path of the recording apparatus 1000 and the path of the liquid discharge head 3.

Figure 5:
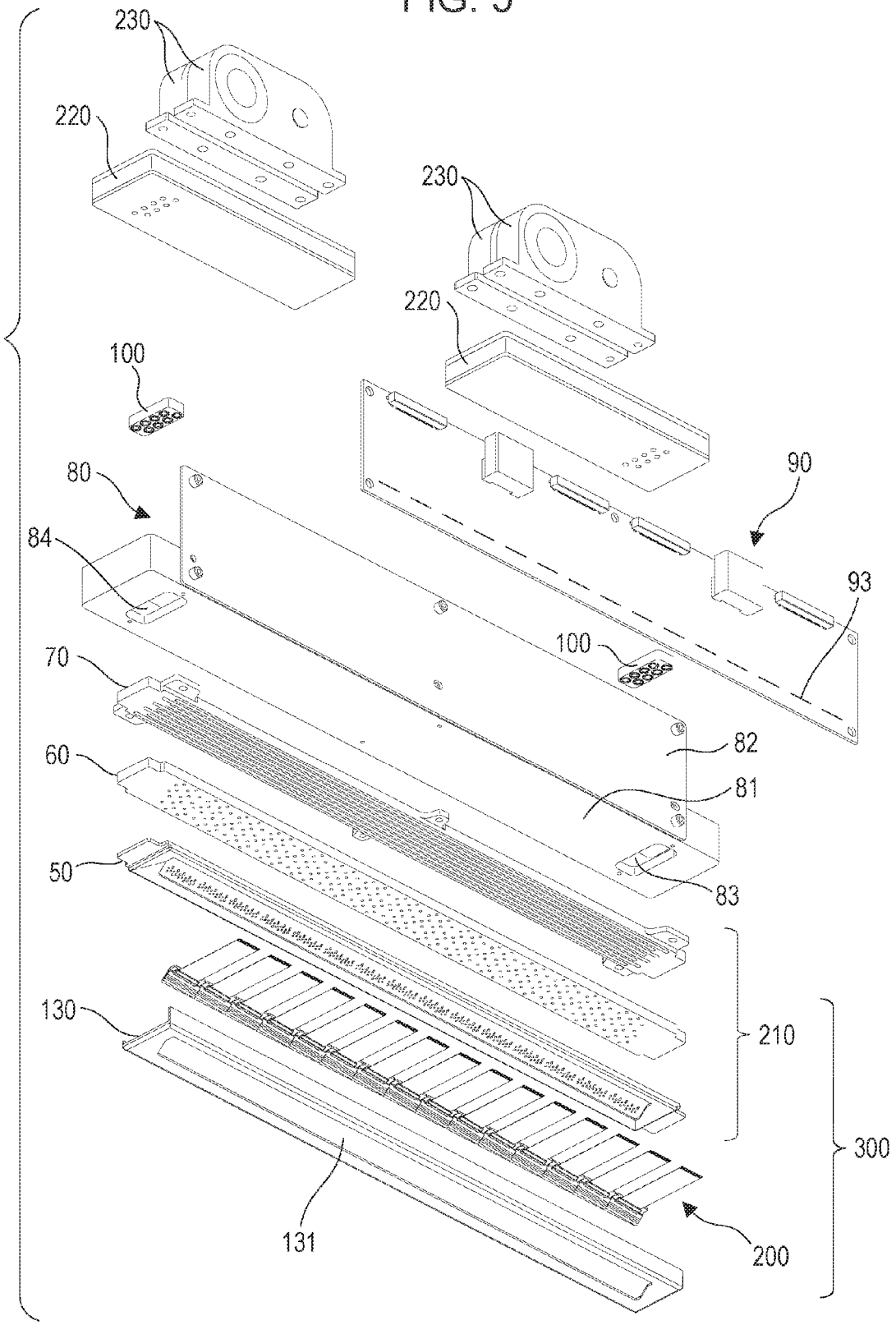
FIG. 5 is a disassembled perspective view of the liquid discharge head.

FIG. 5 illustrates a disassembled perspective view of parts and units making up the liquid discharge head 3, according to the functions thereof. The liquid discharge head 3 has a case 80, and the liquid discharge unit 300, liquid supply units 220, and electric wiring board 90 are attached to this case 80. The liquid connection portions 111 (see FIGS. 2 through 4B) are provided to the liquid supply unit 220, and filters 221 (see FIGS. 2 and 3) for each color, that communicate with each opening of the liquid connection portions 111 to remove foreign substances in the supplied recording liquid, are provided inside the liquid supply units 220. Two liquid supply units 220 and two negative pressure control units 230 are provided to one liquid discharge head 3 in the arrangement illustrated in FIG. 5. Two liquid supply units 220 are each provided with filters 221 for two colors, in the liquid discharge head 3 illustrated in FIGS. 2 and 3. The recording liquids that have passed through the filters 221 are supplied to the respective negative pressure control units 230 provided on the corresponding liquid supply units 220. Each negative pressure control unit 230 has a pressure adjustment mechanism, and markedly attenuates change in pressure drop in the supply system of the recording apparatus 1000 (supply system on the upstream side of the liquid discharge head 3) occurring due to fluctuation in the flow rate of liquid, by the operations of valve and spring members and the like provided in the pressure adjustment mechanism. Accordingly, the negative pressure control units 230 are capable of stabilizing change of negative pressure at the downstream side from themselves (liquid discharge unit 300 side) within a certain range. Each negative pressure control unit 230 for each color has two pressure adjustment valves built in, as described above, these pressure adjustment valves each being set to different control pressures. The high-pressure side pressure adjustment mechanism communicates with the common supply channel 211 within the liquid discharge unit 300, and the low-pressure side pressure adjustment mechanism communicates with the common recovery channel 212.

The case 80 is configured including a liquid discharge unit support member 81 and electric wiring board support member 82, and supports the liquid discharge unit 300 and electric wiring board 90 as well as securing rigidity of the liquid discharge head 3. The electric wiring board support member 82 is for supporting the electric wiring board 90, and is fixed by being screwed to the liquid discharge unit support member 81. The liquid discharge unit support member 81 serves to correct warping and deformation of the liquid discharge unit 300, and thus serves to secure relative positional accuracy of the multiple recording element boards 10, thereby suppressing unevenness in the recorded article. Accordingly, the liquid discharge unit support member 81 preferably has sufficient rigidity. Examples of suitable materials include metal materials such as stainless steel and aluminum, ceramics such as alumina, and so forth. The liquid discharge unit support member 81 has openings 83 and 84, at both ends thereof in the longitudinal direction, into which joint rubber members 100 are inserted. Liquid such as recording liquid supplied from a liquid supply unit 220 passes through a joint rubber member 100 and is guided to a third channel member 70 which is a part making up the liquid discharge unit 300 described later.

The liquid discharge unit 300 is made up of multiple discharge modules 200 and a channel-forming member 210, and a cover member 130 is attached to the face of the liquid discharge unit 300 that faces the recording medium. The cover member 130 is a member having a frame-shaped surface where a long opening 131 is provided as illustrated in FIG. 5, with the recording element boards 10 included in the discharge module 200 and a sealing member 110 (FIG. 9A) being exposed from the opening 131. The frame portion on the perimeter of the opening 131 functions as a contact surface for a cap member that caps off the face of the liquid discharge head 3 where the discharge orifices are formed, when in recording standby. Accordingly, a closed space is preferably formed when capping, by coating the perimeter of the opening 131 with an adhesive agent, sealant, filling member, or the like, to fill in roughness and gaps on the discharge orifice face of the liquid discharge unit 300.

Next, description will be made regarding the configuration of the channel-forming member 210 included in the liquid discharge unit 300. The channel-forming member 210 distributes the liquid such as recording liquid supplied from the liquid supply unit 220 to each of the discharge modules 200, and returns liquid recirculating from the discharge modules 200 to the liquid supply unit 220. The channel-forming member 210 is an article formed by laminating a first channel member 50, a second channel member 60, and the third channel member 70, in that order, as illustrated in FIG. 5, and is fixed to the liquid discharge unit support member 81 by screws. This suppresses warping and deformation of the channel-forming member 210.

Figure 6A:
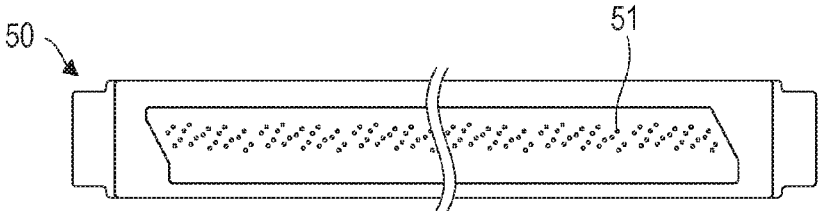
FIGS. 6A through 6F are diagrams illustrating the configuration of the front face and rear face of channel members.
Figure 6B:
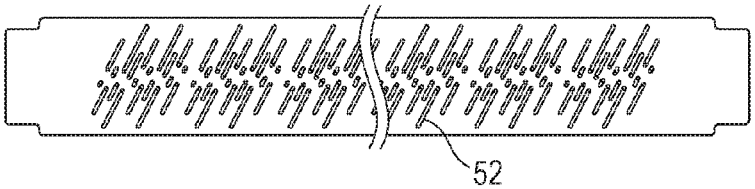
Figure 6C:
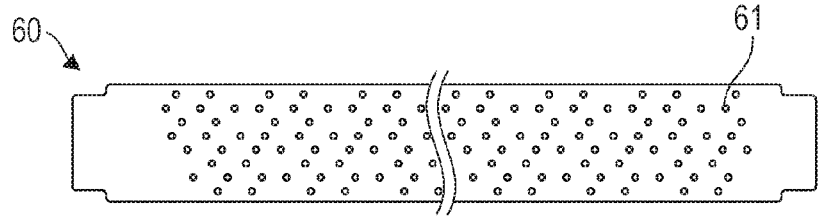
Figure 6D:
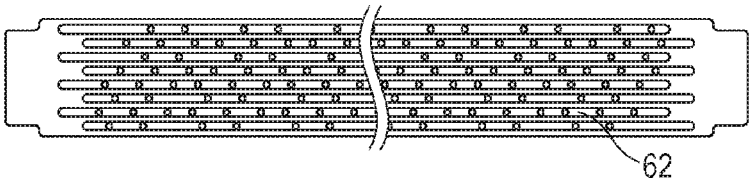
Figure 6E:
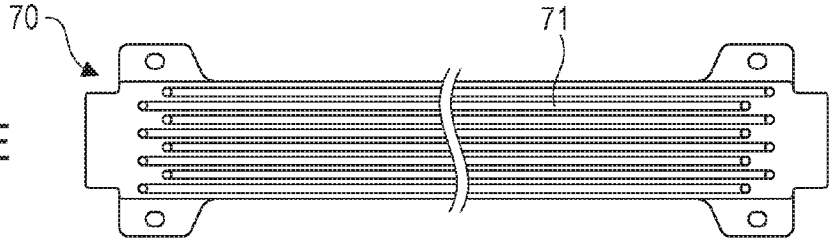
Figure 6F:
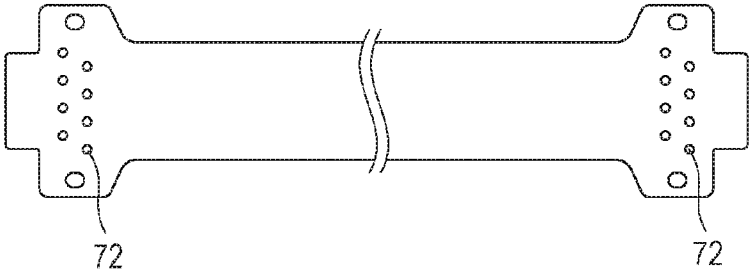
Figure 7:
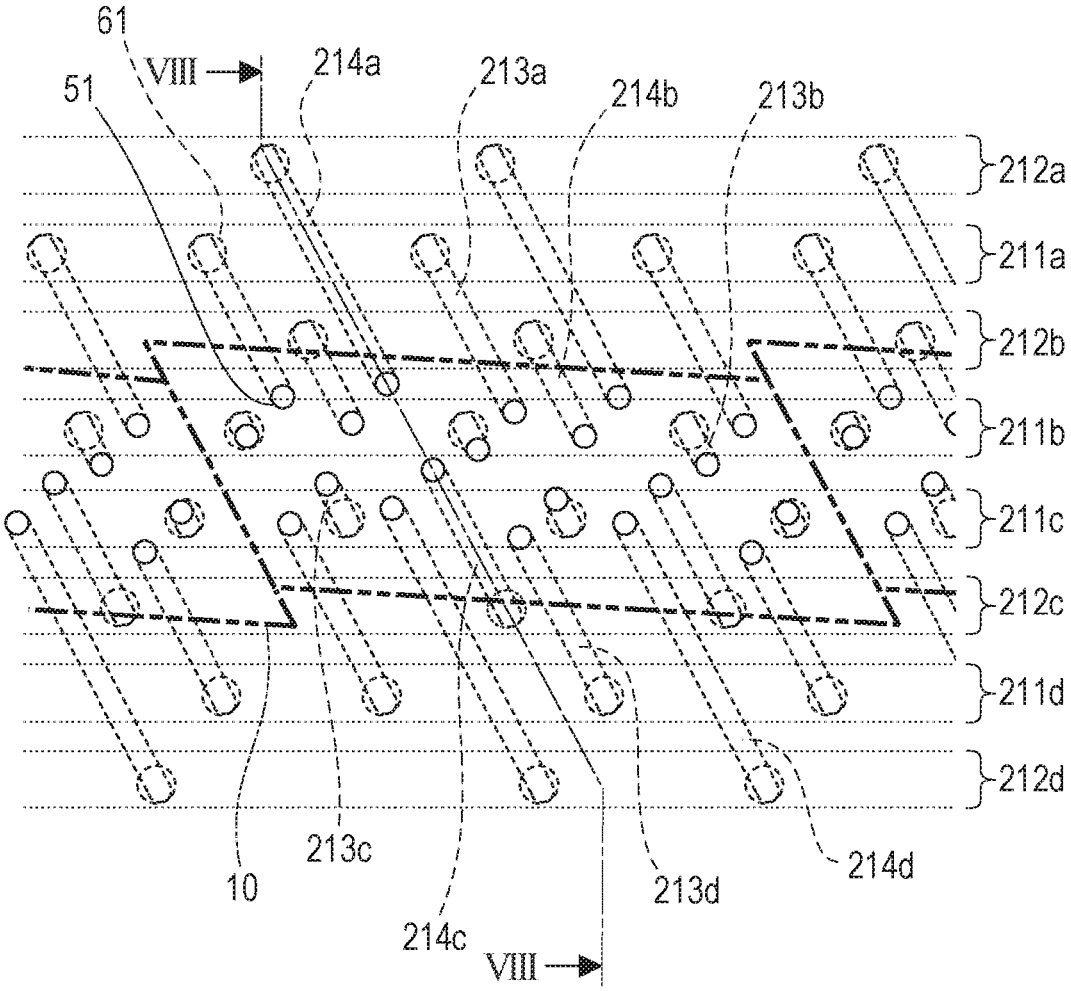
FIG. 7 is a transparent view illustrating relationships between channels.

FIGS. 6A through 6F are diagrams illustrating the front and rear sides of the channel members making up the first through third channel members 50, 60, and 70. FIG. 6A illustrates the side of the first channel member 50 on which the discharge modules 200 are mounted, and FIG. 6F illustrates the face of the third channel member 70 that comes in contact with the liquid discharge unit support member 81. FIG. 6B illustrates the contact face of the first channel member 50 as to the second channel member 60, while FIG. 6C illustrates the contact face of the second channel member 60 as to the first channel member 50. In the same way, FIG. 6D illustrates the contact face of the second channel member 60 as to the third channel member 70, and FIG. 6E illustrates the contact face of the third channel member 70 as to the second channel member 60. By adjoining the faces of the second channel member 60 and third channel member 70 illustrated in FIG. 6D and FIG. 6E with each other form eight common channels extending in the longitudinal direction of the channel members, by common channel grooves 62 and 71 formed thereon. This forms a set of common supply channels 211 and common recovery channels 212 for each of the CMYK colors within the channel-forming member 210 (FIG. 7). Communication ports 72 of the third channel member 70 communicate with the holes in the joint rubber members 100, so as to communicate with the liquid supply unit 220 by fluid connection. Multiple communication ports 61 are formed on the bottom face of the common channel grooves 62 of the second channel member 60, communicating with one end of individual channel grooves 52 of the first channel member 50. Communication ports 51 are formed at the other end of the individual channel grooves 52 of the first channel member 50 so as to communicate with the multiple discharge modules 200 by fluid connection via the communication ports 51. These individual channel grooves 52 allow the channels to be consolidated at the middle of the channel member in the transverse direction of the first channel member 50. In the following description, When common supply channels 211 of individual colors of recording liquid are to be indicated, reference numerals 211*a* through 211*d* will be used instead of reference numeral 211, and when common recovery channels 212 of individual colors of recording liquid are to be indicated, reference numerals 212*a* through 212*d* will be used instead of reference numeral 212. In the same way, when individual supply channels 213 of individual colors of recording liquid are to be indicated, reference numerals 213*a* through 213*d* will be used instead of reference numeral 213, and when individual recovery channels 214 of individual colors of recording liquid are to be indicated, reference numerals 214*a* through 214*d* will be used instead of reference numeral 214.

The first through third channel members 50, 60, and 70, making up the channel member 210, preferably are corrosion-resistant as to the recording liquid, and formed from a material having a low linear expansion coefficient. Examples suitable materials include alumina, liquid crystal polymer (LCP), and composite materials (resin materials) where inorganic filler such as fine particles of silica or fiber or the like has been added to a base material such as polyphenyl sulfide (PPS) or polysulfone (PSF). The channel-forming member 210 may be formed by laminating the three channel members 50, 60, and 70 and adhering to each other using an adhesive agent, or in a case of selecting a composite resin material for the material, the three channel members may be joined by fusing.

Next, the connection relationship of the channels within the channel-forming member 210 will be described with reference to FIG. 7. FIG. 7 is a partially enlarged transparent view of channels within the channel-forming member 210 formed by joining the first through third channel members 50, 60, and 70, as viewed from the side of the first channel member 50 on which the discharge modules 200 are mounted. The regions in FIG. 7 surrounded by the single-dot dashed line corresponds to the regions where the recording element boards 10 are disposed. The channel-forming member 210 has, for each color, common supply channels 211*a* through 211*d* and common recovery channels 212*a* through 212*d* extending in the longitudinal direction of the liquid discharge head 3. Multiple individual supply channels 213*a* through 213*d* of each color formed of the individual channel grooves 52 are connected to the common supply channels 211*a* through 211*d* via the communication ports 61. Multiple individual recovery channels 214*a* through 214*d* of each color formed of the individual channel grooves 52 are connected to the common recovery channels 212*a* through 212*d* via the communication ports 61. This channel configuration enables recording liquid to be consolidated at the recording element boards 10 situated at the middle of the channel-forming member 210, from the common supply channels 211 via the individual supply channels 213. Recording liquid can also be recovered from the recording element boards 10 to the common recovery channels 212 via the individual recovery channels 214.

Figure 8:
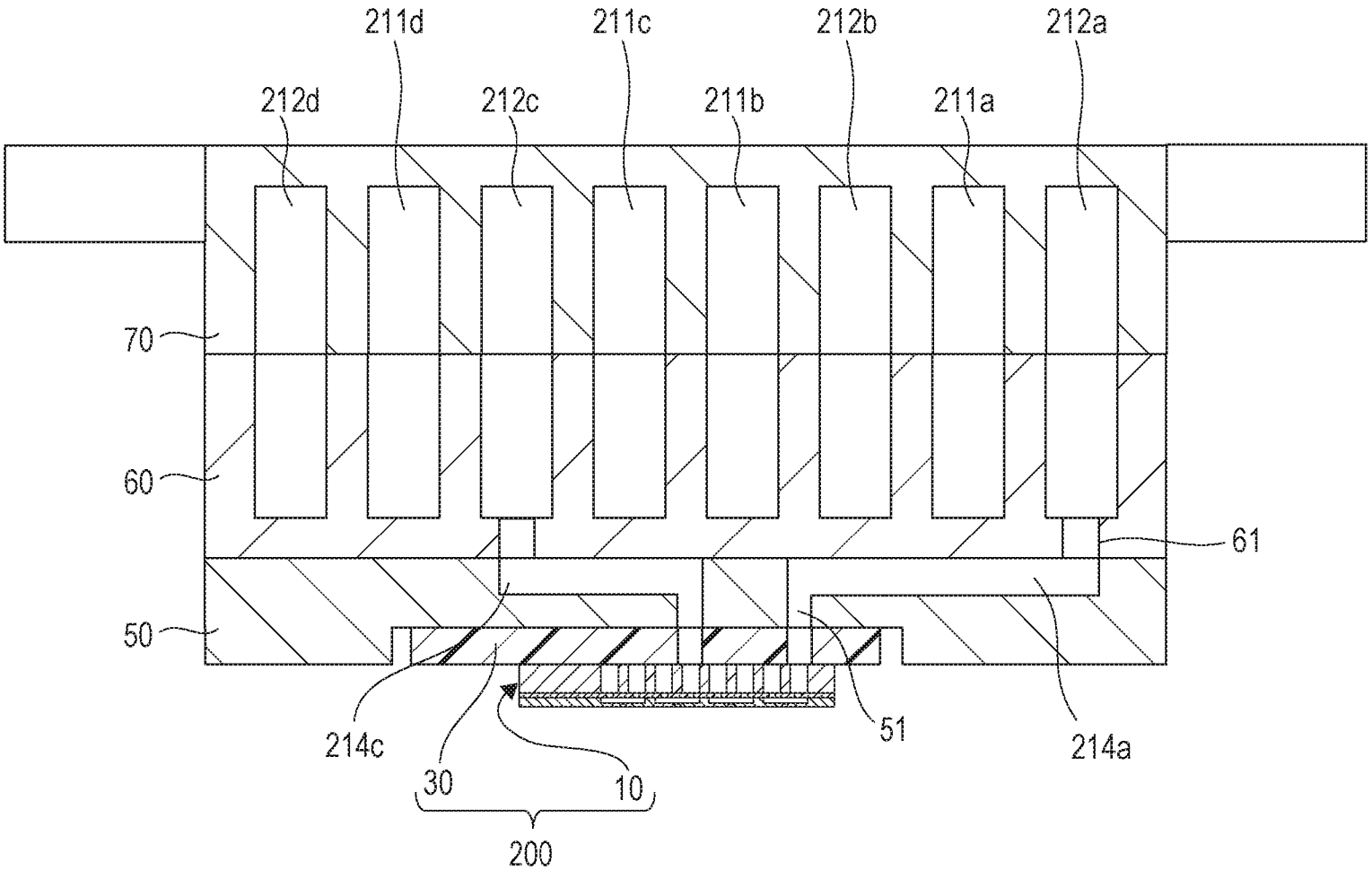
FIG. 8 is a cross-sectional view illustrating channel-forming members and a discharge module.

FIG. 8 illustrates the cross-sectional configuration of the channel-forming member 210 and discharge module 200 along line VIII-VIII in FIG. 7. FIG. 8 illustrates that individual recovery channels 214*a* and 214*c* communicate with the discharge module 200 via the communication ports 51. Although FIG. 8 only illustrates the individual recovery channels 214*a* and 214*c*, the individual supply channels 213 and the discharge module 200 communicate at a different cross-section, as illustrated in FIG. 7. Channels for supplying recording liquid from the first channel member 50 to recording elements 15 (FIG. 10B), provided to the recording element board 10, are formed in a support member 30 included in the discharge module 200 and the recording element boards 10. Further, channels for recovering (recirculating) part or all of the liquid supplied to the recording elements 15 to the first channel member 50 are formed in the support member 30 and recording element boards 10. The common supply channels 211 of each color are connected to the high-pressure side pressure adjustment mechanism of the negative pressure control unit 230 of the corresponding color via its liquid supply unit 220. In the same way, the common recovery channels 212 are connected to the low-pressure side pressure adjustment mechanism of the negative pressure control units 230 of the corresponding color, via the liquid supply units 220. Pressure difference is generated between the common supply channels 211 and common recovery channels 212 by these pressure adjustment mechanisms in the negative pressure control units 230. Accordingly, a flow occurs for each color in the liquid discharge head 3 where the channels are connected as illustrated in FIGS. 7 and 8, in the order of common supply channel 211→individual supply channels 213→recording element board 10→individual recovery channels 214→common recovery channel 212.

Description of Discharge Module

Figure 9A:
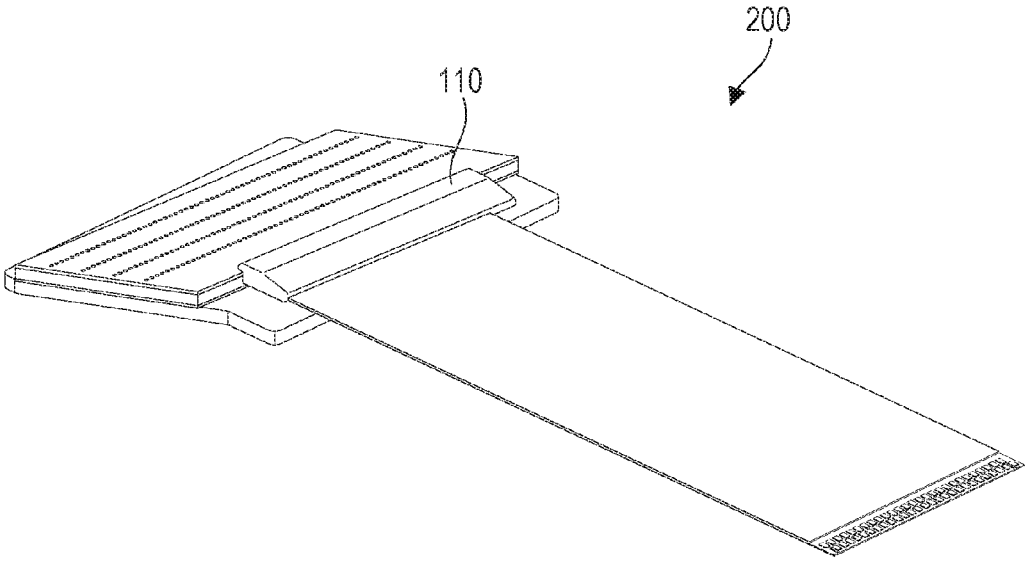
FIGS. 9A and 9B are diagrams describing a discharge module.
Figure 9B:
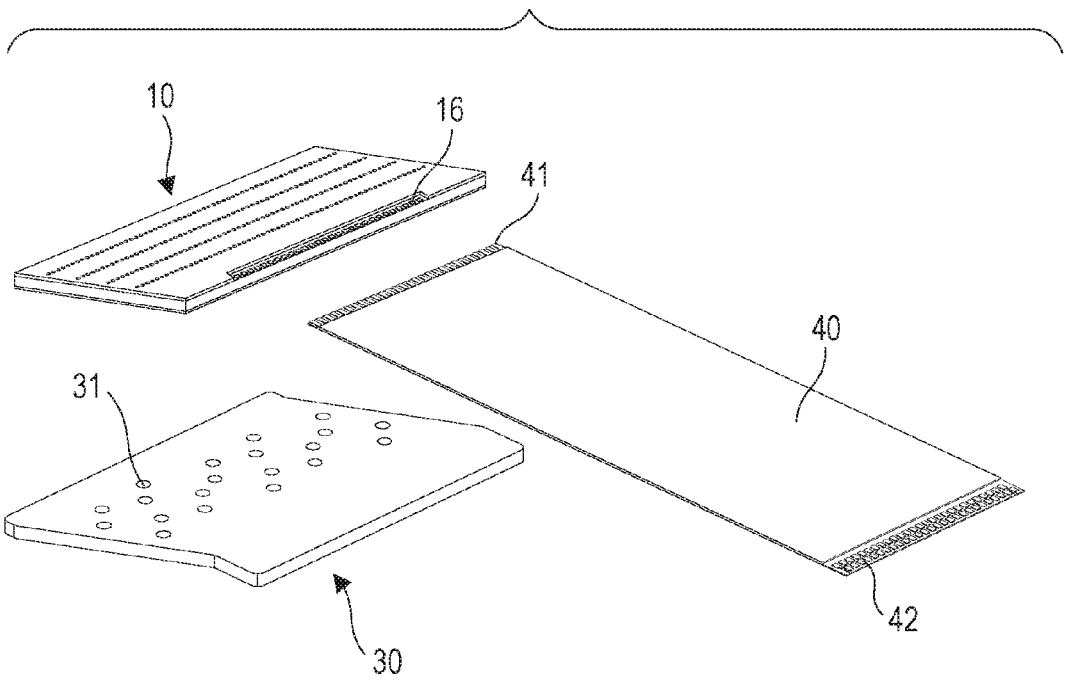

Next, the discharge module 200 will be described. FIG. 9A illustrates a perspective view of one discharge module 200, and FIG. 9B illustrates a disassembled view thereof. The method of manufacturing the discharge module 200 is as follows. First, a recording element board 10 and flexible printed circuit board 40 are adhered to a support member 30 in which liquid communication ports 31 have been formed beforehand. Subsequently, terminals 16 on the recording element board 10 are electrically connected to terminals 41 on the flexible printed circuit board 40 by wire bonding, following which the wire-bonded portion (electric connection portion) is covered by a sealant 110 to seal off. Terminals 42 at the other end of the flexible printed circuit board 40 from the recording element board 10 are electrically connected to connection terminals 93 (FIG. 5) of the electric wiring board 90. The support member 30 is a support member that supports the recording element board 10, and also is a channel member communicating between the recording element board 10 and the channel-forming member 210 by fluid connection, and accordingly should have a high degree of flatness, and also should be able to be joined to the recording element board 10 with a high degree of reliability. Examples of suitable materials of the support member 30 include alumina and resin materials.

Description of Structure of Recording Element Board

Figure 10A:
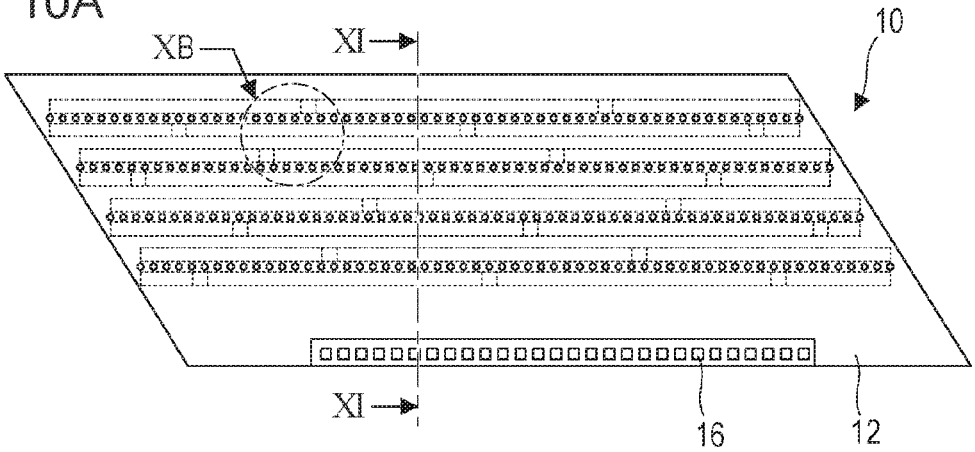
FIGS. 10A through 10C are diagrams illustrating the configuration of a recording element board.
Figure 10B:
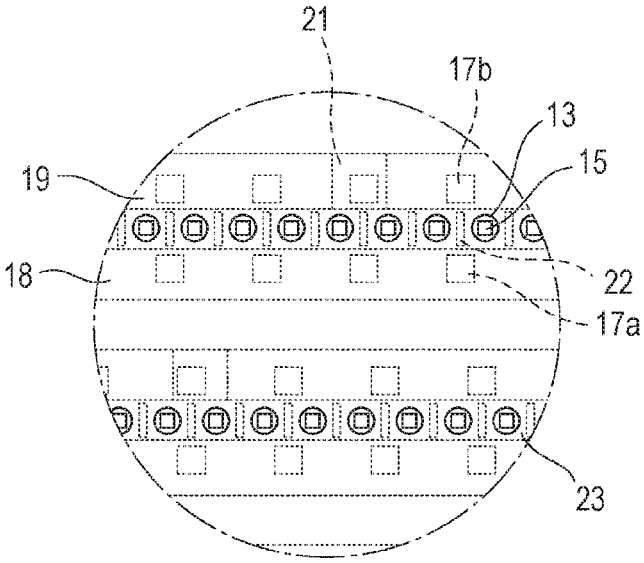
Figure 10C:
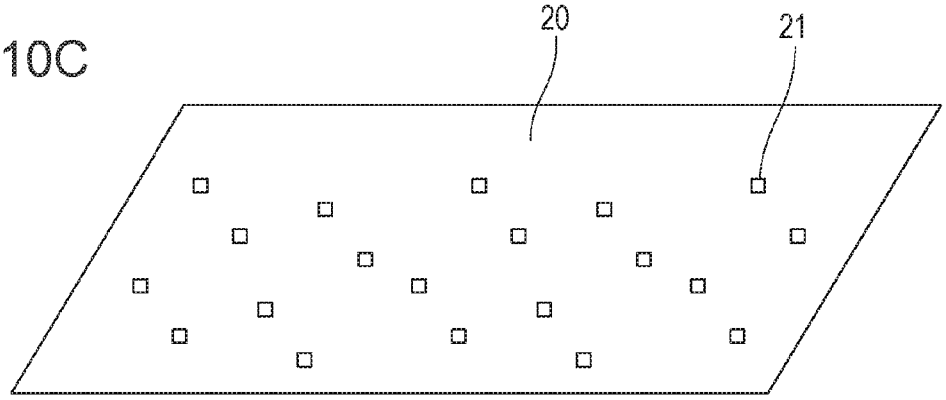

The configuration of the recording element board 10 will be described next. FIG. 10A is a plan view of the side of the recording element board 10 on which discharge orifices 13 have been formed, FIG. 10B is an enlarged view of the portion indicated by XB in FIG. 10A, and FIG. 10C is a plan view of the rear face of the recording element board 10 from that in FIG. 10A. The recording element board 10 has a discharge orifice forming member 12, where multiple discharge orifices 13 for rows, as illustrated in FIG. 10A. Four discharge orifice rows corresponding to the four colors CMYK that are the colors of the recording liquid are formed on the discharge orifice forming member 12. Note that hereinafter, the direction in which the discharge orifice rows, where multiple discharge orifices 13 are arrayed, extend, will be referred to as "discharge orifice row direction". The recording elements 15 that are heat-generating elements to cause the liquid to bubble by thermal energy are disposed at positions corresponding to the discharge orifices 13, as illustrated in FIG. 10B. Pressure chambers 23 that contain the recording elements 15 are sectioned off by partitions 22. The recording elements 15 are electrically connected to the terminals 16 in FIG. 10A by electric wiring (omitted from illustration) provided to the recording element board 10. The recording elements 15 generate heat to cause the liquid to boil, based on pulse signals input from a control circuit of the recording apparatus 1000, via the electric wiring board 90 (FIG. 5) and flexible printed circuit board 40 (FIG. 9B), causing the liquid in the pressure chambers 23 to boil. The force of bubbling due to this boiling discharges liquid from the discharge orifices 13. A liquid supply channel 18 extends along one side of each discharge orifice row, and a liquid recovery channel 19 along the other, as illustrated in FIG. 10B. The liquid supply channels 18 and liquid recovery channels 19 are channels extending in the direction of the discharge orifice rows provided on the recording element board 10, and communicate with the discharge orifices 13 via supply ports 17*a* and recovery ports 17*b*, respectively.

Figure 11:
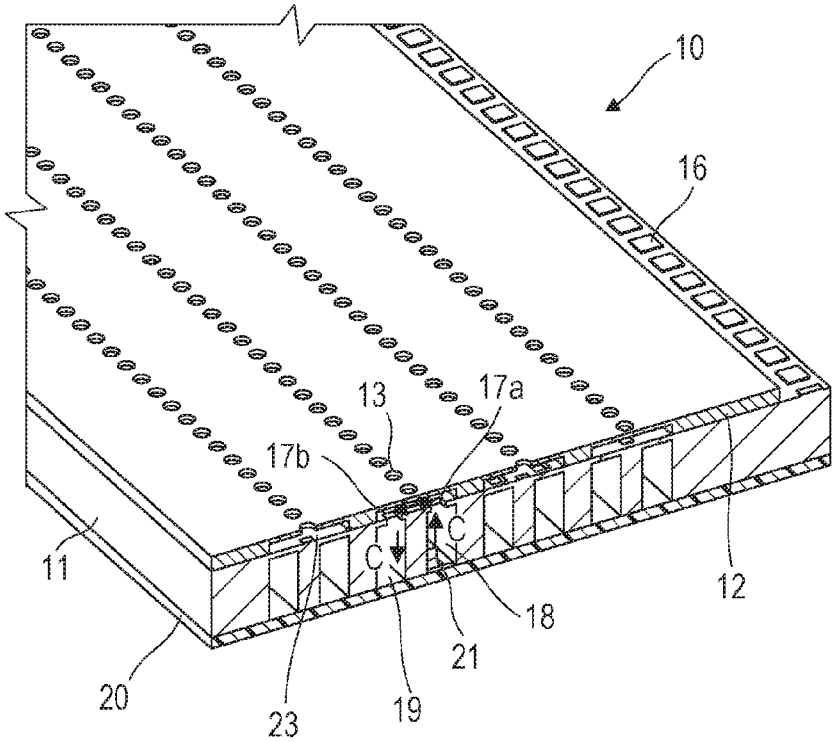
FIG. 11 is a partial cutaway perspective view illustrating the configuration recording element board.

A sheet-shaped cover 20 is laminated on the rear face from the face of the recording element board 10 on which the discharge orifices 13 are formed, the cover 20 having multiple openings 21 communicating with the liquid supply channel 18 and liquid recovery channel 19 which will be described later, as illustrated in FIGS. 10C and 11. In the example described here, three openings 21 are provided in the cover 20 for each liquid supply channel 18, and two openings 21 are provided for each liquid recovery channel 19. The openings 21 of the cover 20 communicate with the multiple communication ports 51 illustrated in FIG. 6A, as illustrated in FIG. 10B. The cover 20 functions as a lid making up part of the liquid supply channel 18 and liquid recovery channel 19, formed on the substrate 11 of the recording element board 10, as illustrated in FIG. 11. The cover 20 preferably is sufficiently corrosion-resistant as to liquid such as the recording liquid, and has to have a high degree of precision regarding the opening shapes of the openings 21 and the positions thereof from the perspective of color mixture prevention. Accordingly, a photosensitive resin material or silicon plate is preferably used as the material for the cover 20, with the openings 21 being formed by photolithography process. The cover 20 thus is for converting the pitch of channels by the openings 21, and the cover 20 preferably is thin, taking into consideration pressure drop, and preferably is formed of a photosensitive resin film.

Next, the flow of liquid within the recording element board 10 will be described. FIG. 11 is a perspective view, illustrating a cross-section of the recording element board 10 and cover 20 taken along plane XI-XI in FIG. 10A. The recording element board 10 is formed by laminating the substrate 11 formed of silicon (Si) and the discharge orifice forming member 12 formed of a photosensitive resin, with the cover 20 joined on the rear face of the substrate 11. The recording elements 15 are formed on the other face side of the substrate 11 (see FIG. 10B) with the grooves making up the liquid supply channels 18 and liquid recovery channels 19 extending along the discharge orifice rows being formed at the reverse side thereof. The liquid supply channels 18 and liquid recovery channels 19 formed by the substrate 11 and cover 20 are respectively connected to the common supply channels 211 and common recovery channels 212 within the channel member 210, and there is differential pressure between the liquid supply channels 18 and liquid recovery channels 19. Individual supply channels 213 and individual recovery channels 214 are formed in the first channel member 50. The individual supply channels 213 connect the liquid supply channel 18 and common supply channel 211, and the individual recovery channels 214 connect the liquid recovery channel 19 and common recovery channel 212. When multiple discharge orifices 13 of the liquid discharge head 3 are discharging liquid and recording, at discharge orifices not performing discharge operations, this differential pressure causes the liquid in the liquid supply channel 18 to flow in the order of supply port 17*a*→pressure chamber 23→recovery port 17*b* and to the liquid recovery channel 19. This flow is indicated by arrows C in FIG. 11. This flow enables recording liquid that has thickened due to vaporization of the medium from the discharge orifices 13, bubbles, foreign substance, and so forth, to be recovered to the liquid recovery channel 19 from the discharge orifices 13 and pressure chambers 23 where recording is not being performed. This also enables thickening of recording liquid at the discharge orifices 13 and pressure chambers 23 to be suppressed. Liquid such as recording liquid recovered to the liquid recovery channels 19 is recovered in the order of the communication ports 51 in the channel-forming member 210, the individual recovery channels 214, and the common recovery channel 212, via the openings 21 of the cover 20 and the liquid communication ports 31 of the support member 30 (see FIG. 9B). This recovered liquid is ultimately recovered to the supply path of the recording apparatus 1000.

That is to say, liquid such as recording liquid supplied from the main unit of the recording apparatus 1000 to the liquid discharge head 3 is supplied and recovered by flowing in the order described below. First, the liquid flows from the liquid connection portions 111 of the liquid supply unit 220 into the liquid discharge head 3. This liquid then is supplied to the joint rubber members 100, communication ports 72 and common channel grooves 71 provided to the third channel member 70, common channel grooves 62 and communication ports 61 provided to the second channel member 60, and individual channel grooves 52 and communication ports 51 provided to the first channel member 50. Thereafter, the liquid is supplied to the pressure chambers 23 in the order of the liquid communication ports 31 provided to the support member 30, the openings 21 provided to the cover 20, and the liquid supply channels 18 and supply ports 17*a* provided to the substrate 11. Liquid that has been supplied to the pressure chambers 23 but not discharged from the discharge orifices 13 flows in the order of the recovery ports 17*b* and liquid recovery channels 19 provided to the substrate 11, the openings 21 provided to the cover 20, and the liquid communication ports 31 provided to the support member 30. Thereafter, the liquid flows in the order of the communication ports 51 and individual channel grooves 52 provided to the first channel member 50, the communication ports 61 and common channel grooves 62 provided to the second channel member 60, the common channel grooves 71 and communication ports 72 provided to the third channel member 70, and the joint rubber members 100. The liquid further flows outside of the liquid discharge head 3 from the liquid connection portions 111 provided to the liquid supply unit 220. In a case where the first circulation arrangement illustrated in FIG. 2 has been employed, liquid that has flowed in from the liquid connection portions 111 passes through the negative pressure control unit 230 and then is supplied to the joint rubber members 100. On the other hand, in a case where the second circulation arrangement illustrated in FIG. 3 has been employed, liquid recovered from the pressure chambers 23 passes through the joint rubber members 100, and then flows out of the liquid discharge head 3 from the liquid connection portions 111 via the negative pressure control unit 230.

Also, not all liquid flowing in from one end of the common supply channel 211 of the liquid discharge unit 300 is supplied to the pressure chamber 23 via the individual supply channels 213*a*. As illustrated in FIGS. 2 and 3, there is liquid that flows from the other end of the common supply channel 211 and through the liquid supply unit 220 without ever entering the individual supply channels 213*a*. Thus, providing channels where liquid flows without going through the recording element board 10 enables backflow in the circulatory flow of liquid to be suppressed, even in a case where the recording element board 10 has fine channels where the flow resistance is great. Accordingly, the liquid discharge head 3 is capable of suppressing thickening of liquid in pressure chambers and portions nearby the discharge orifices, thereby suppressing deviation of discharge and non-discharge, so high image quality recording can be performed as a result.

Description of Positional Relationship Among Recording Element Boards

Figure 12:
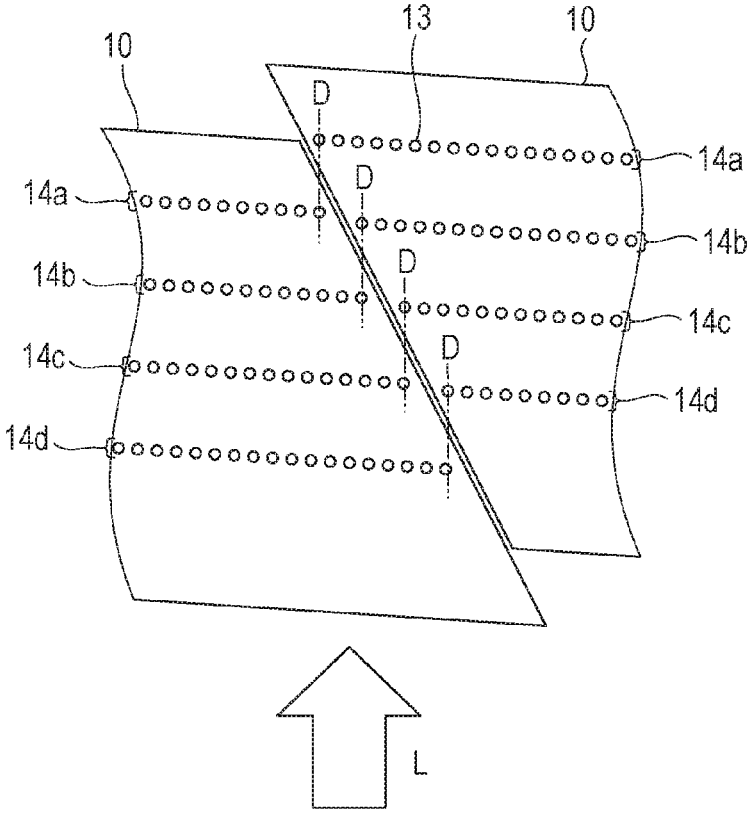
FIG. 12 is a plan view illustrating adjacent recording element boards.

The liquid discharge head 3 has multiple discharge modules 200, as described above. FIG. 12 is a partial enlargement of adjacent portions of recording element boards 10 in two adjacent discharge modules 200. The recording element boards 10 here are shaped as parallelograms, as illustrated in FIGS. 10A through 10C. The discharge orifice rows 14*a* through 14*d* where discharge orifices 13 are arrayed on the recording element boards 10 are disposed inclined to the conveyance direction L of the recording medium by a certain angle, as illustrated in FIG. 12. At least one discharge orifice of discharge orifice rows at adjacent portions of the recording element boards 10 is made to overlap in the conveyance direction L of the recording medium thereby. In FIG. 12, two discharge orifices 13 on the lines D are in a mutually overlapping relationship. This layout enables black streaks and blank portions in the recorded image to be made less conspicuous by driving control of the mutually overlapping discharge orifices 13, even in a case where the positions of the recording element board 10 are somewhat deviated from the predetermined position. The configuration illustrated in FIG. 12 can be used even in a case where the multiple recording element boards 10 are laid out in a straight line (inline) instead of in a staggered arrangement. Thus, black streaks and blank portions at overlapping portions between the recording element boards 10 can be handled while suppressing increased length of the liquid discharge head 3 in the conveyance direction of the recording medium. Although the shape of the primary face of the recording element board 10 here is a parallelogram, this is not restrictive. The configuration of the present invention can be suitably applied even in cases where of using recording element boards 10 of which the shape is a rectangle, a trapezoid, or another shape.

Figure 13:
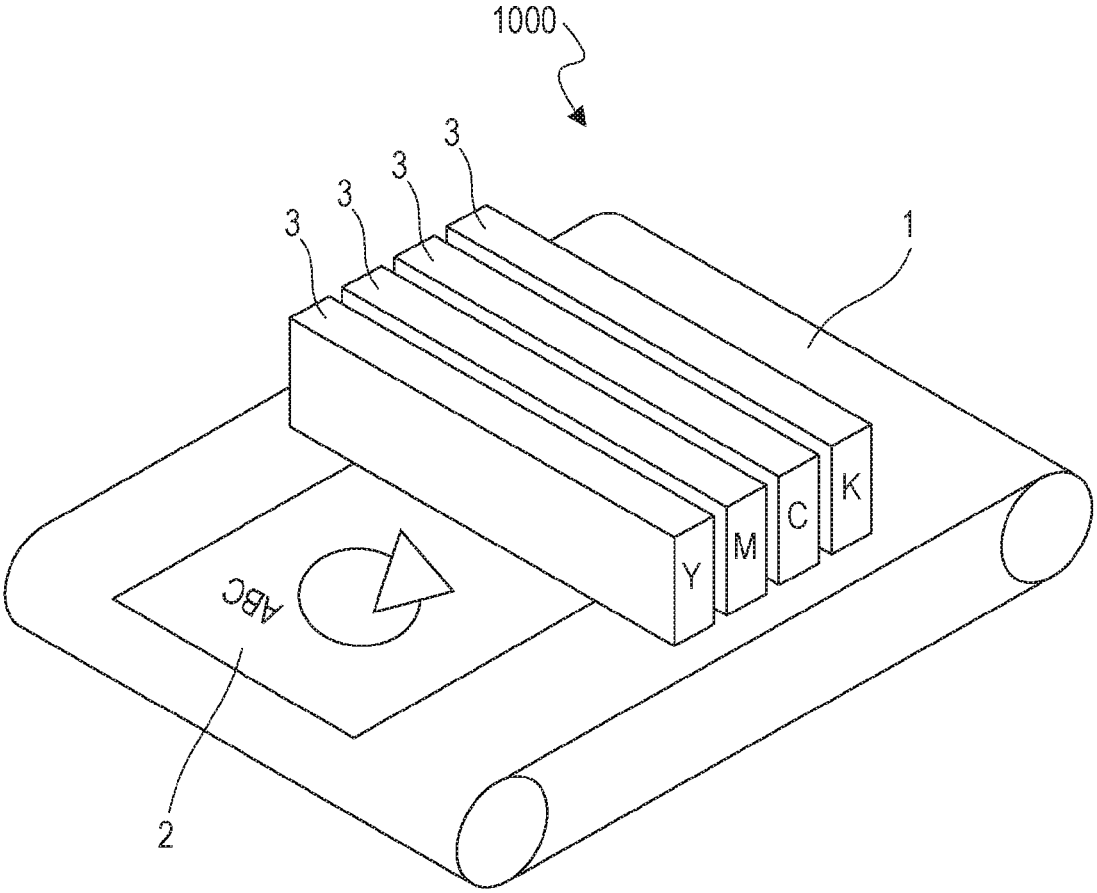
FIG. 13 is a diagram illustrating a schematic configuration of a liquid discharge apparatus according to a second configuration example.

Description of Liquid Discharge Apparatus According to Second Configuration Example The liquid discharge apparatus to which the present invention can be applied is not restricted to that in the above-described first configuration example. The configuration of an inkjet recording apparatus 1000 (hereinafter, also referred to as "recording apparatus") of a second configuration example of the liquid discharge apparatus according to the present invention will be described below. FIG. 13 illustrates a schematic configuration of the recording apparatus 1000 that is the liquid discharge apparatus according to the second configuration example. Note that portions that differ from the first configuration example will primarily be described, and portions that are the same as the first configuration example will be omitted from description.

The recording apparatus 1000 illustrated in FIG. 13 differs from the first configuration example with regard to the point that full-color recording is performed on the recording medium 2 by arraying in parallel four monochrome liquid discharge heads 3, each corresponding to one of the CMYK colors. Although the number of discharge orifice rows usable per color in the first configuration example was one row, the number of discharge orifice rows usable per color in the second configuration example is multiple (20 rows in FIG. 20A described later). This enables extremely high-speed recording to be performed, by allocating recording data to multiple discharge orifice rows. Even if there are discharge orifices that exhibit non-discharge, reliability is improved by a discharge orifice at a corresponding position in the conveyance direction L of the recording medium in another row performing discharge in a complementary manner. Accordingly, the recording apparatus 1000 according to the second configuration example is suitable for industrial printing and so forth. The supply system of the recording apparatus 1000, the buffer tank 1003, and the main tank 1006 are connected to the liquid discharge heads 3 by fluid connection, in the same way as in the first configuration example. Each liquid discharge head 3 is also electrically connected to an electric control unit that transmits electric power and discharge control signals to the liquid discharge head 3. Either of the first and second circulation arrangements illustrated in FIGS. 2 and 3 respectively, may be used in the second configuration example, in the same way as in the first configuration example.

Description of Structure of Liquid Discharge Head

Figure 14A:
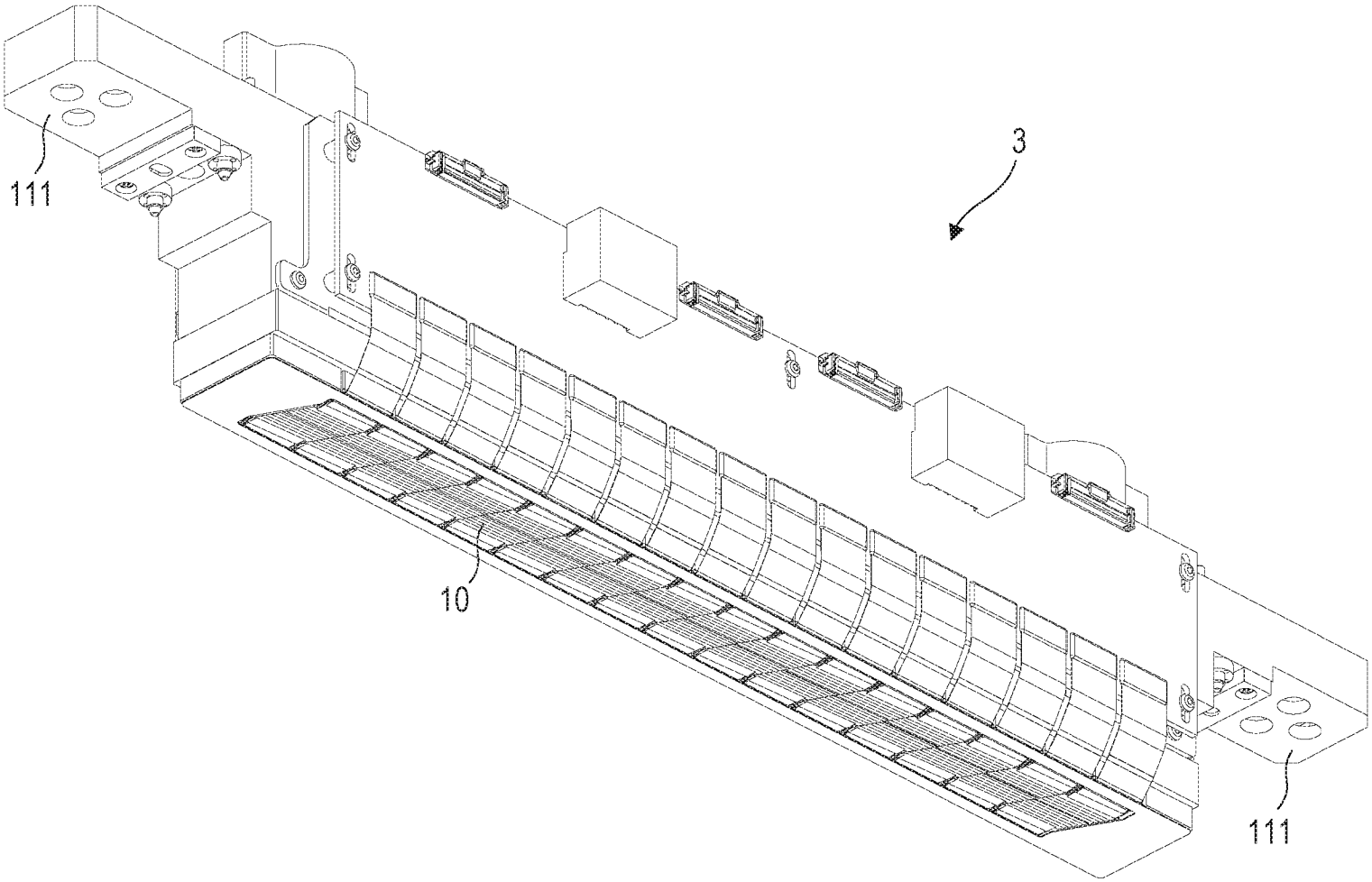
FIGS. 14A and 14B are perspective views illustrating the configuration of the liquid discharge head.
Figure 14B:
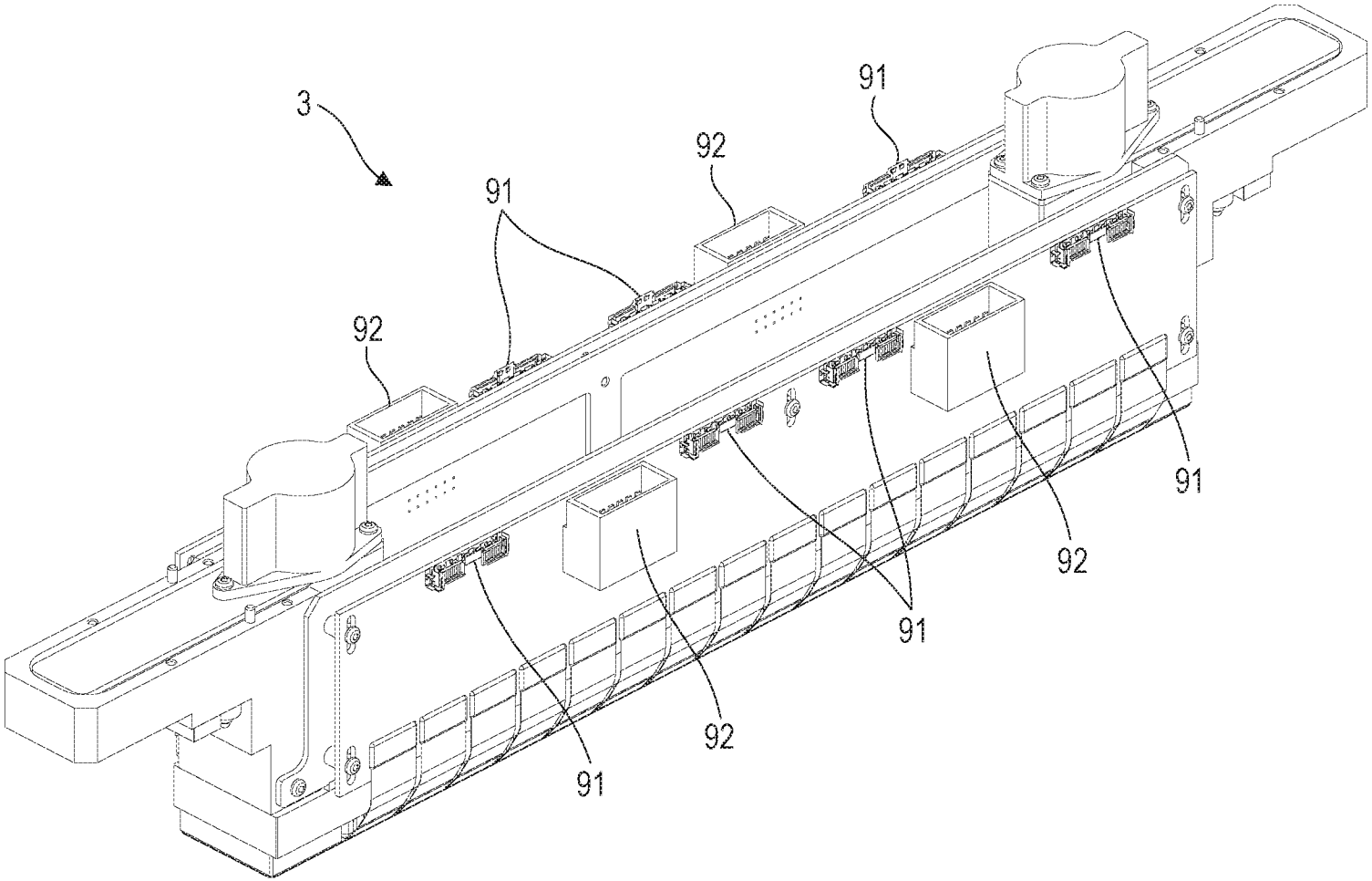

Description will be made regarding the structure of the liquid discharge head 3 according to the second configuration example with reference to FIGS. 14A and 14B. FIG. 14A is a perspective diagram of the liquid discharge head 3 as viewed from the side of the face where discharge orifices are formed. FIG. 14B is a perspective view from the opposite side from FIG. 14A. The liquid discharge head 3 has 16 recording element boards 10 arrayed in a straight line in the longitudinal direction thereof, and is an inkjet line liquid discharge head (page-wide) that can record with recording liquid of one color. The liquid discharge head 3 has the liquid connection portions 111, signal input terminals 91, and power supply terminals 92 in the same way as the first configuration example. However, the input terminals 91 and power supply terminals 92 are disposed on both sides of the liquid discharge head 3, since the number of discharge orifice rows is greater than that in the first configuration example. This is to reduce voltage drop and signal transmission delay that occurs at wiring portions provided to the recording element boards 10.

Figure 15:
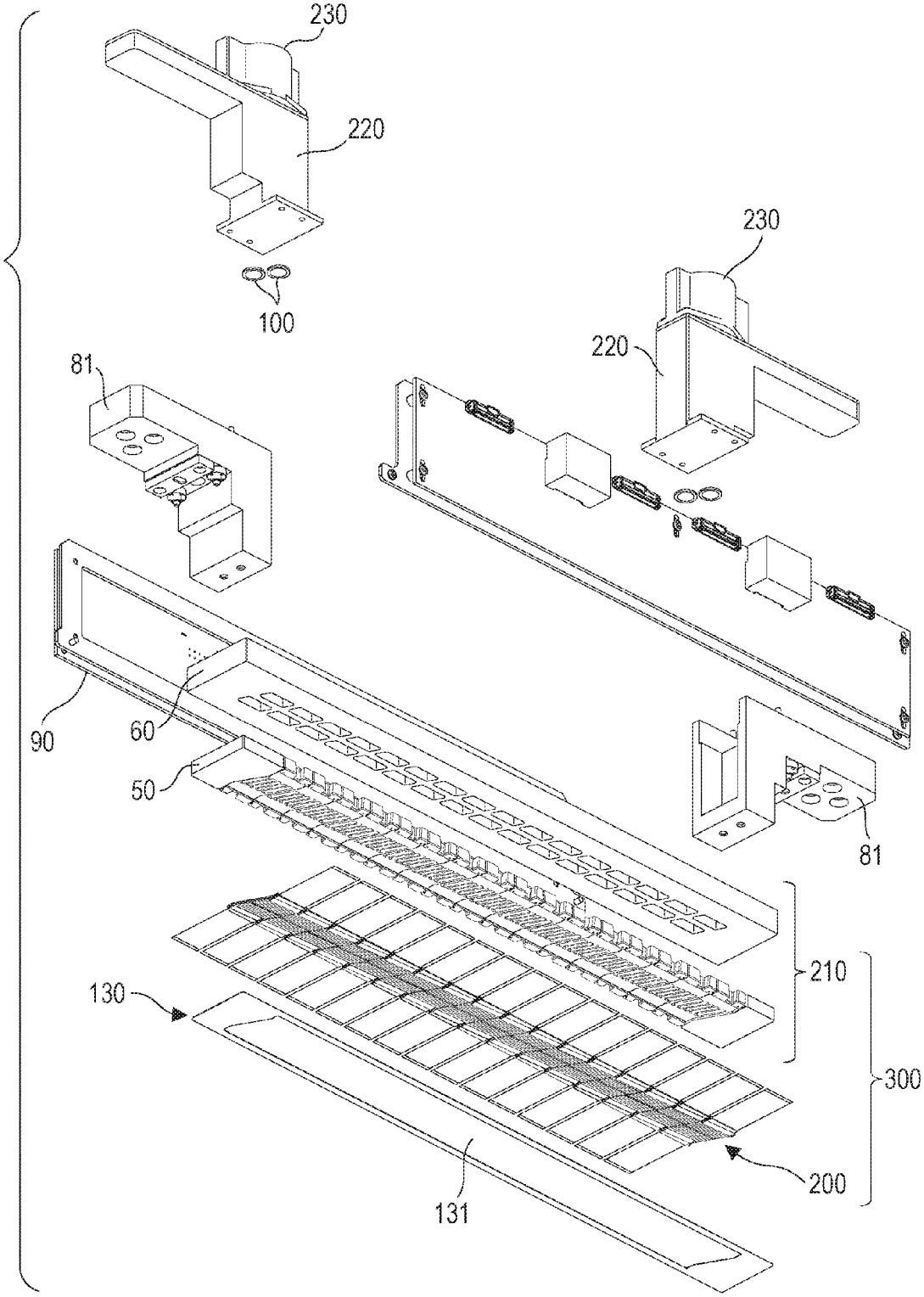
FIG. 15 is a disassembled perspective view of the liquid discharge head.

FIG. 15 is a disassembled perspective view of the liquid discharge head 3 according to the second configuration example, illustrating each part or unit making up the liquid discharge head 3 disassembled according to function. The roles of the units and members, and the order of liquid flow through the liquid discharge head 3, are basically the same as in the first configuration example, but the function by which the rigidity of the liquid discharge head is guaranteed is different. The rigidity of the liquid discharge head was primarily guaranteed in the first configuration example by the liquid discharge unit support member 81, but the rigidity of the liquid discharge head is guaranteed in the second configuration example by the second channel member 60 included in the liquid discharge unit 300. There are liquid discharge unit support members 81 connected to both ends of the second channel member 60 in the present second configuration example. This liquid discharge unit 300 is mechanically enjoined to a carriage of the recording apparatus 1000, whereby the liquid discharge head 3 is positioned. Liquid supply units 220 having negative pressure control units 230, and the electric wiring board 90, are joined to the liquid discharge unit support members 81. Filters (omitted from illustration) are built into the two liquid supply units 220. The second configuration example is not arranged for each negative pressure control unit 230 to perform two types of pressure control. One of the two negative pressure control units 230 is set to control pressure at a relatively high negative pressure, serving as a high-pressure side negative pressure control unit, and the other is set to control pressure at a relatively low negative pressure, serving as a low-pressure side negative pressure control unit. When the high-pressure side and low-pressure side negative pressure control units 230 are disposed on both ends in the longitudinal direction of the liquid discharge head 3 as illustrated in FIG. 15, the flow of liquid on the common supply channel 211 and the common recovery channel 212 that extend in the longitudinal direction of the liquid discharge head 3 are mutually opposite. This promotes heat exchange between the common supply channel 211 and common recovery channel 212, so that the temperature difference between the two common channels can be reduced. This is advantageous in that temperature difference does not readily occur among the multiple recording element boards 10 disposed along the common supply channel 211 and common recovery channel 212, and accordingly unevenness in recording due to temperature difference does not readily occur.

The channel-forming member 210 of the liquid discharge unit 300 will be described in detail next. The channel-forming member 210 is the first channel member 50 and second channel member 60 that have been laminated as illustrated in FIG. 15, and distributes liquid such as recording liquid supplied from the liquid supply unit 220 to the discharge modules 200. The channel-forming member 210 also serves as a recovery channel member for returning liquid recirculating from the discharge modules 200 to the liquid supply unit 220. The second channel member 60 of the channel-forming member 210 is a member in which the common supply channel 211 and common recovery channel 212 have been formed, and also primary undertakes the rigidity of the liquid discharge head 3. Accordingly, the material of the second channel member 60 preferably is sufficiently corrosion-resistant as to the liquid such as recording liquid and has high mechanical strength. Examples of suitably-used materials include stainless steel, titanium (Ti), alumina, or the like.

Figure 16A:
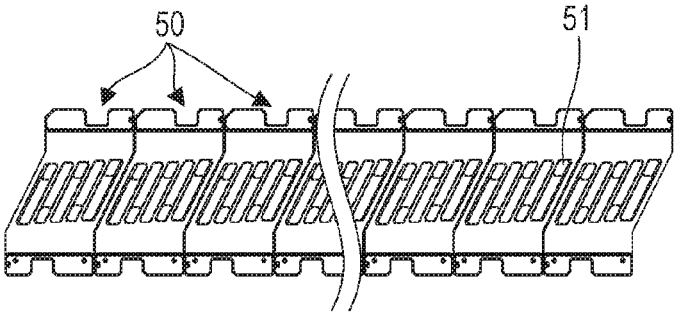
FIGS. 16A through 16E are diagrams illustrating the configuration of channel members.
Figure 16B:
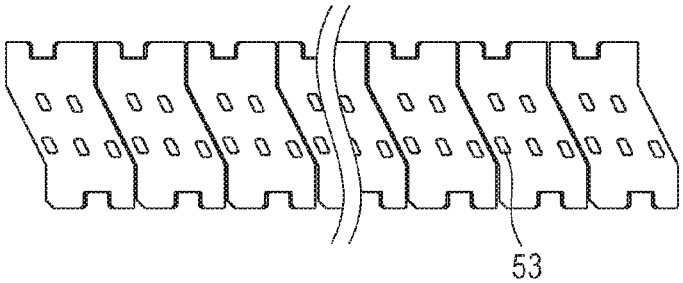
Figure 16C:
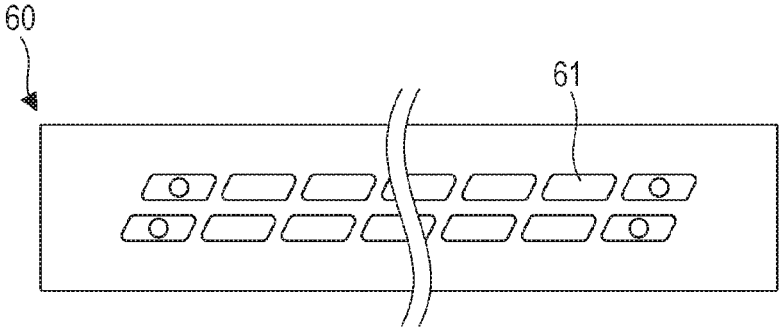
Figure 16D:
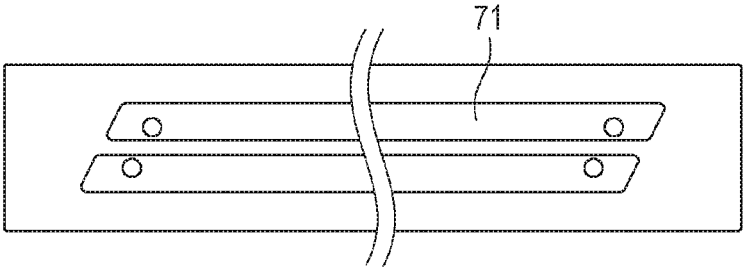
Figure 16E:
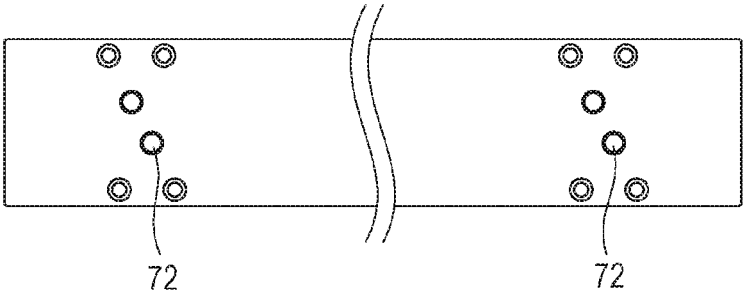

Next, details of the first channel member 50 and second channel member 60 will be described with reference to FIGS. 16A through 16E. FIG. 16A illustrates the face of the first channel member 50 on the side where the discharge modules 200 are attached, and FIG. 16B is a diagram illustrating the reverse face therefrom, that comes into contact with the second channel member 60. Unlike the case in the first configuration example, the first channel member 50 according to the second configuration example is an arrangement where multiple members corresponding to the discharge modules 200 are arrayed adjacently. Employing this divided structure enables a length corresponding to the length required for the liquid discharge head 3 to be realized, by arraying multiple such modules. This configuration can particularly be suitably used in relatively long-scale liquid discharge heads corresponding to sheets of JIS (Japanese Industrial Standards) B2 size and even larger dimensions, for example. The communication ports 51 of the first channel member 50 communicate with the discharge modules 200 by fluid connection as illustrated in FIG. 16A, and individual communication ports 53 of the first channel member 50 communicate with the communication ports 61 of the second channel member 60 by fluid connection as illustrated in FIG. 16B. FIG. 16C illustrates the face of the second channel member 60 that comes in contact with the first channel member 50, FIG. 16D illustrates a cross-section of the middle portion of the second channel member 60 taken in the thickness direction, and FIG. 16E is a diagram illustrating the face of the second channel member 60 that comes into contact with the liquid supply unit 220. The functions of the channels and communication ports of the second channel member 60 are the same as in with one color worth of recording liquid in the first configuration example. One of the common channel grooves 71 of the second channel member 60 is the common supply channel 211 illustrated in FIG. 17 and the other is the common recovery channel 212, each being supplied with liquid from one end side to the other end side in the longitudinal direction of the liquid discharge head 3. Unlike the case in the first configuration example, the directions of the flow or liquid for the common supply channel 211 and common recovery channel 212 are mutually opposite directions in the longitudinal direction of the liquid discharge head 3 in this configuration example.

Figure 17:
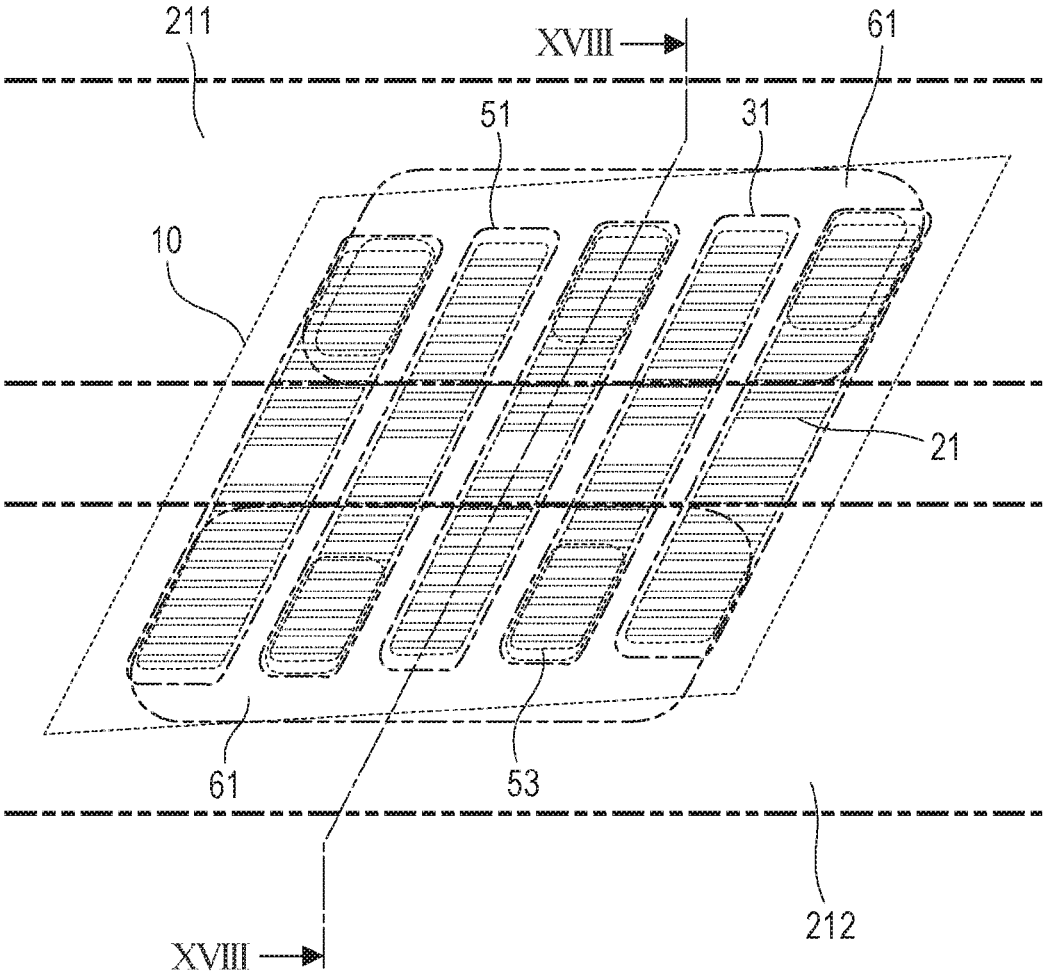
FIG. 17 is a perspective view illustrating connection relationships in the channel members.

FIG. 17 illustrates the connection relationship regarding the channels between the recording element boards 10 and the channel-forming member 210. The set of the common supply channel 211 and common recovery channel 212 extending in the longitudinal direction of the liquid discharge head 3 is provided within the channel-forming member 210, as illustrated in FIG. 17. The communication ports 61 of the second channel member 60 are each positioned with and connected to the individual communication ports 53 of the first channel member 50, thereby forming a liquid supply path from the communication ports 72 of the second channel member 60 to the communication ports 51 of the first channel member 50 via the common supply channel 211. In the same way, a liquid supply path from the communication ports 72 of the second channel member 60 to the communication ports 51 of the first channel member 50 via the common recovery channel 212 is also formed.

Figure 18:
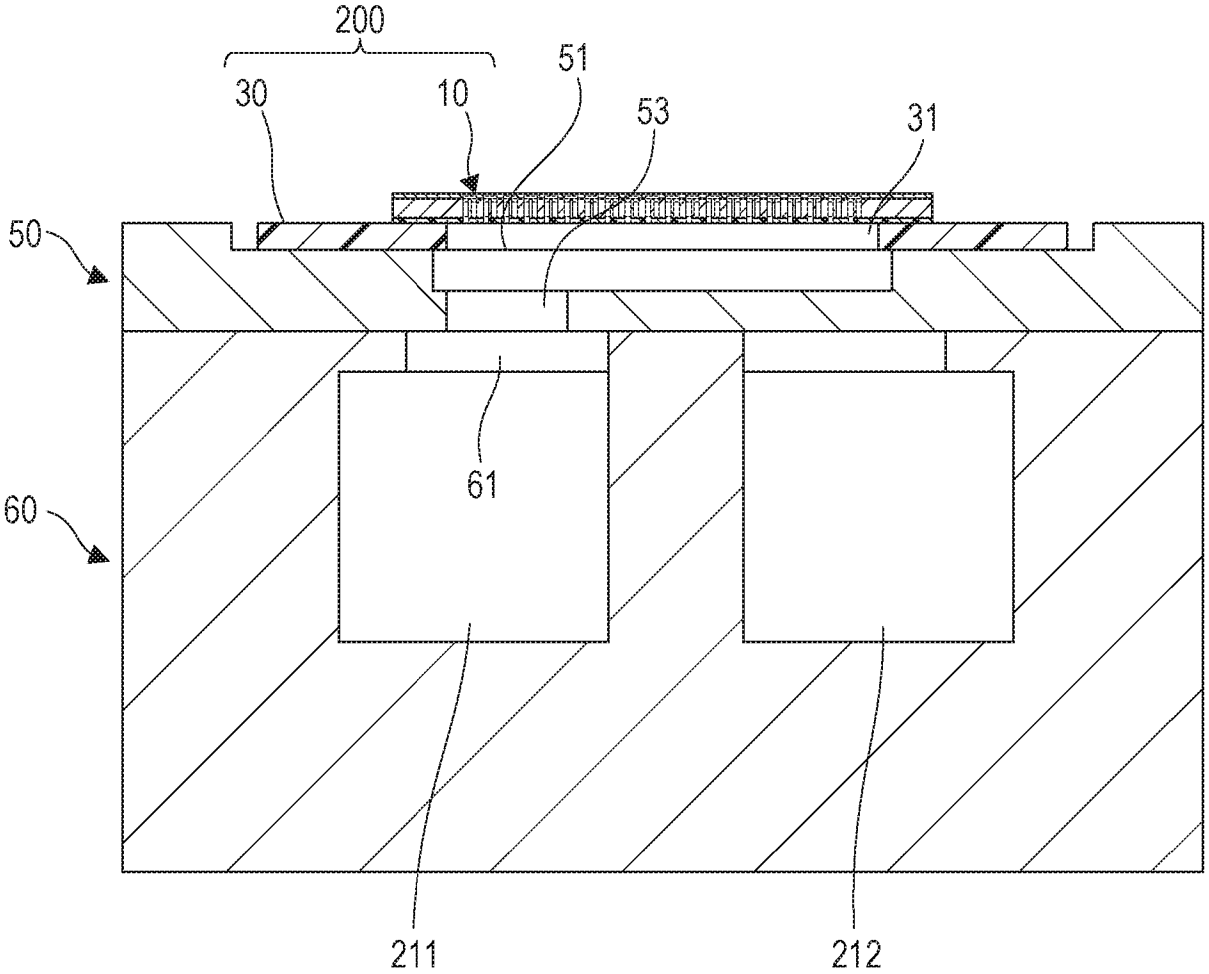
FIG. 18 is a cross-sectional view illustrating the channel-forming members and discharge module.

FIG. 18 is a diagram illustrating a cross-section taken along XVIII-XVIII in FIG. 17. FIG. 18 shows how the common supply channel 211 connects to the discharge module 200 through the communication port 61, individual communication port 53, and communication port 51. Although omitted from illustration in FIG. 18, it can be clearly seen from FIG. 17 that another cross-section would show the common recovery channel 212 connected to the discharge module 200 through a similar path. Channels are formed on the discharge modules 200 and recording element boards 10 to communicate with the pressure chambers 23 where the discharge orifices 13 are formed in the same way as in the first configuration example. Part or all of the supplied liquid recirculates through the pressure chambers 23 corresponding to the discharge orifices 13 that are not performing discharging operations, by these channels. The common supply channel 211 is connected to the high-pressure side negative pressure control unit 230, and the common recovery channel 212 to the low-pressure side negative pressure control unit 230, via the liquid supply unit 220, in the same way as in the first configuration example. Accordingly, a flow is generated by the differential pressure generated by the negative pressure control units 230, that flows from the common supply channel 211 through the pressure chambers 23 of the recording element board 10 to the common recovery channel 212.

Description of Discharge Module

Figure 19A:
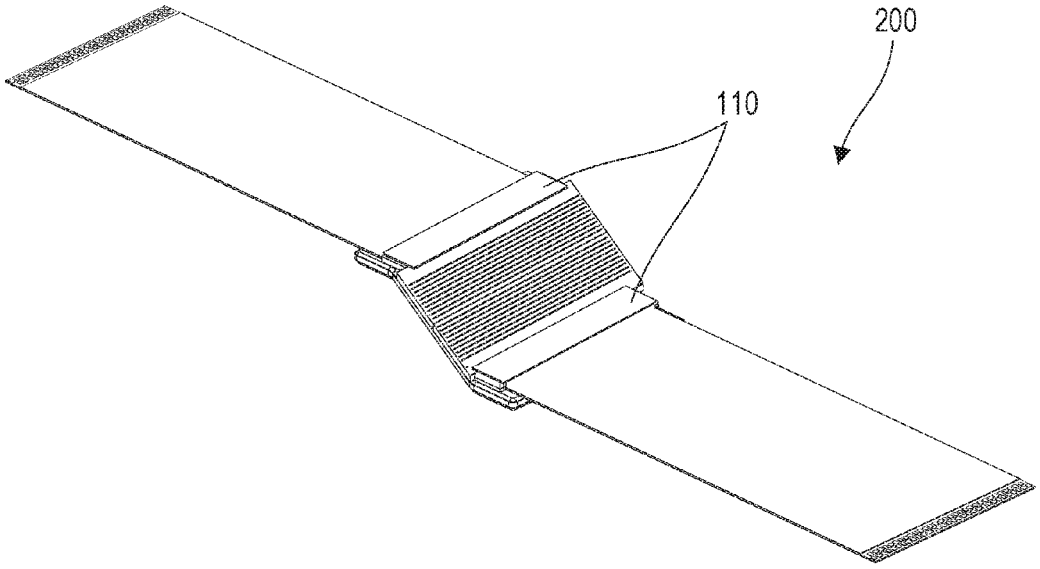
FIGS. 19A and 19B are diagrams describing the discharge module.
Figure 19B:
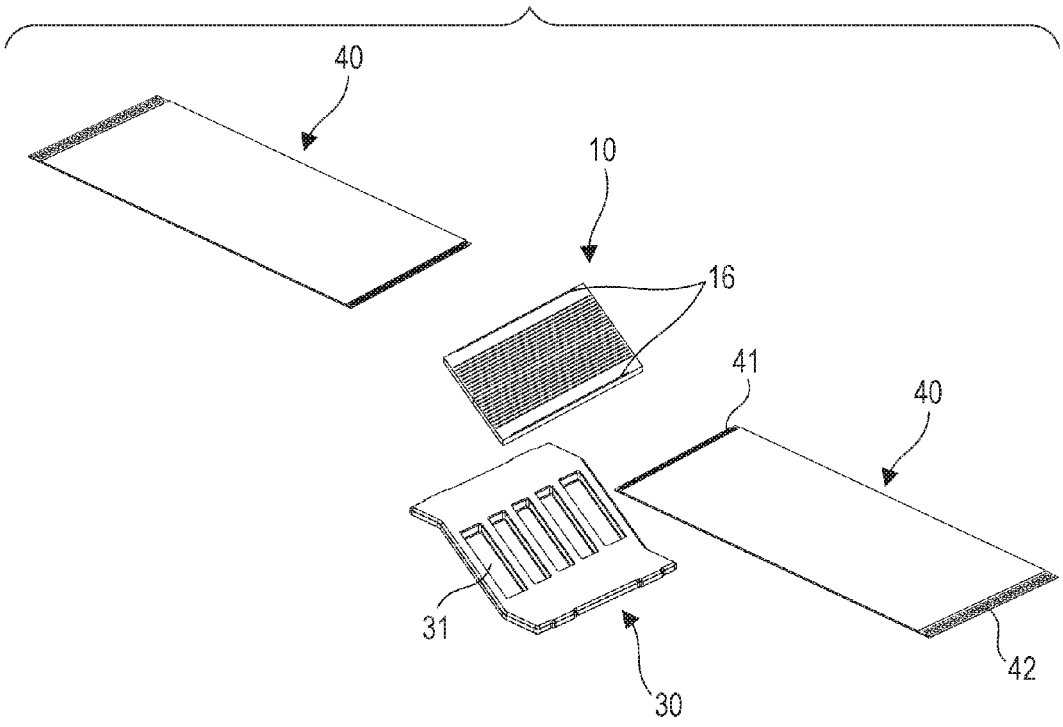

Next, the discharge module 200 according to the second configuration example will be described. FIG. 19A is a perspective view of a discharge module 200, and FIG. 19B is a disassembled view thereof. The difference as to the first configuration example is the point that multiple terminals 16 are disposed arrayed on both sides (the long side portions of the recording element board 10) following the direction of the multiple discharge orifice rows of the recording element board 10. Another point is that two flexible printed circuit boards 40 are provided to one recording element board 10 and are electrically connected to the terminals 16. The reason is that the number of discharge orifice rows provided on the recording element board 10 is 20 rows, for example, which is an increase over the four rows in the first configuration example. That is to say, the object is to keep the maximum distance from the terminals 16 to the recording elements 15 provided corresponding to the discharge orifice row short, thereby reducing voltage drop and signal transmission delay that occurs at wiring portions provided within the recording element board 10. Liquid communication ports 31 of the support member 30 are provided to the recording element board 10, and are opened so as to span all discharge orifice rows. Other points are the same as in the first configuration example.

Description of Structure of Recording Element Board

Figure 20A:
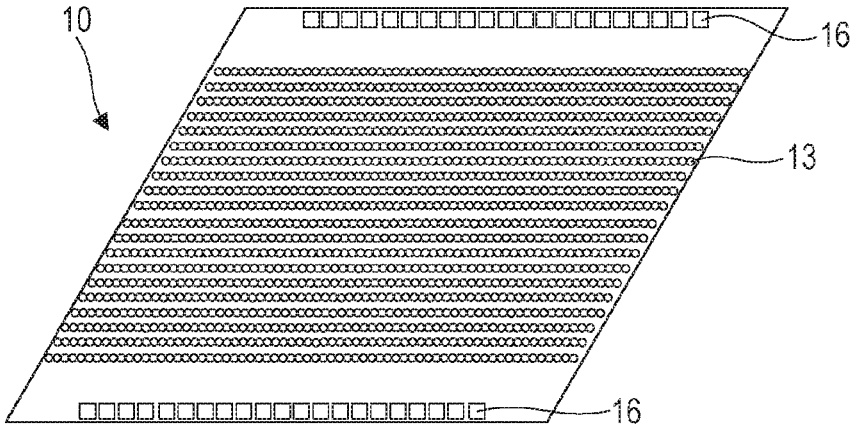
FIGS. 20A through 20C are diagrams illustrating the configuration of the recording element board.
Figure 20B:
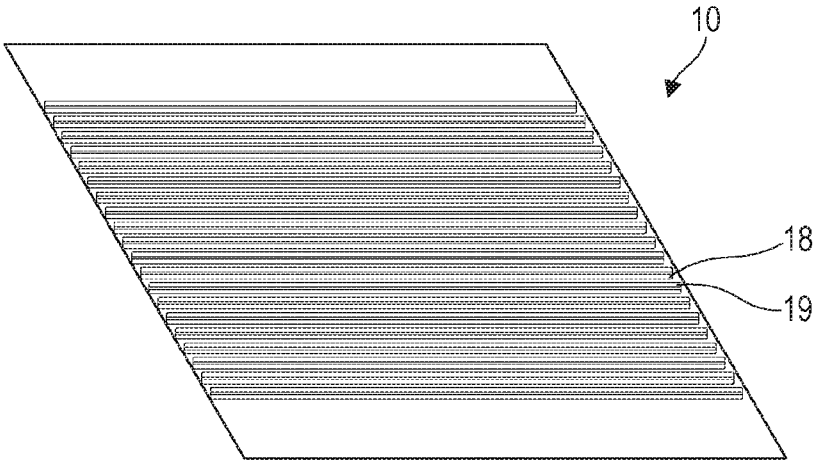
Figure 20C:
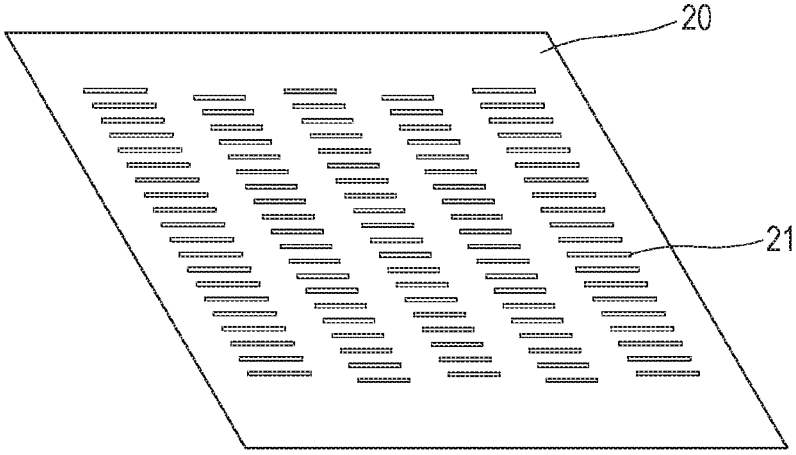

Next, the configuration of the recording element board 10 according to the second configuration example will be described. FIG. 20A is a plan view illustrating the face of the recording element board 10 on the side where the discharge orifices 13 are disposed, FIG. 20B is a diagram illustrating a portion where liquid supply channels 18 and liquid recovery channels 19 are formed, and FIG. 20C is a plan view illustrating the reverse face of that illustrated in FIG. 20A. FIG. 20B is a schematic diagram illustrating the face of the recording element board 10 in a state where the cover 20 provided on the rear face side of the recording element board 10 is removed in FIG. 20C. Liquid supply channels 18 and liquid recovery channels 19 are alternately provided on the rear face of the recording element board 10 following the discharge orifice row direction, as illustrated in FIG. 20B. Despite the number of discharge orifice rows being much greater than that in the first configuration example, a substantial difference from the first configuration example is that the terminals 16 are disposed on both side portions of the recording element board 10 following the discharge orifice row direction, as described above. The basic configuration is the same as that in the first configuration example, such as one set of a liquid supply channel 18 and liquid recovery channel 19 being provided for each discharge orifice row, openings 21 that communicate with the liquid communication ports 31 of the support member 30 being provided to the cover 20, and so forth.

Figure 21:
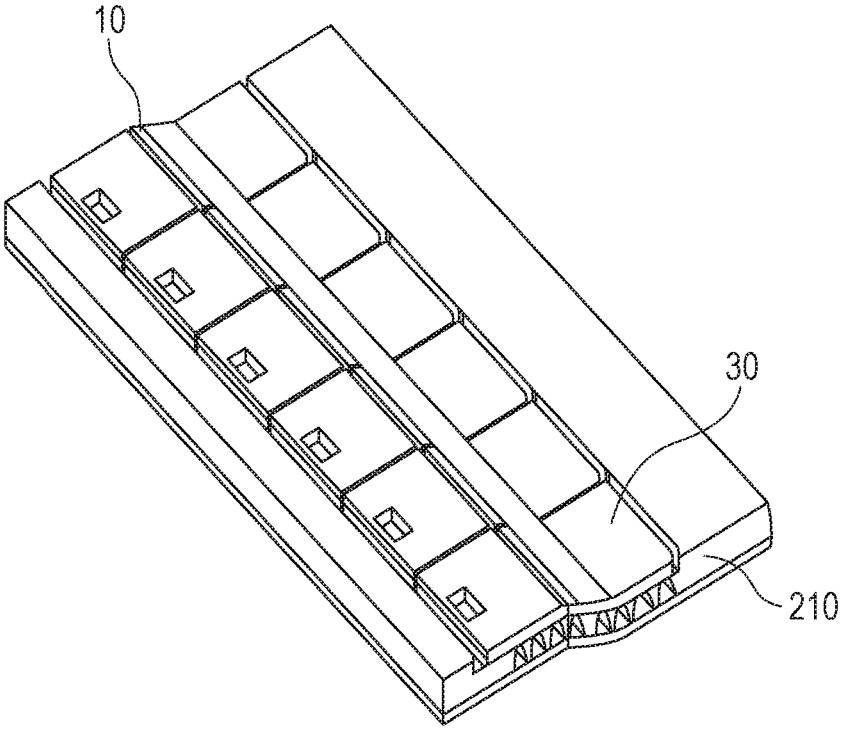
FIG. 21 is a perspective view for describing a liquid discharge unit in a liquid discharge head according to an embodiment of the present invention.

The following is a description of a configuration according to the present invention regarding a liquid discharge head or liquid discharge apparatus that can control temperature rise due to backflow of hot liquid to the pressure chambers, without variation in discharge properties. FIG. 21 illustrates the liquid discharge unit 300 of a liquid discharge head 3 according to an embodiment of the present invention. The case 80, electric wiring board 90, liquid supply unit 220, and like configurations of the liquid discharge head 3 according to the present embodiment are the same as those already described in FIGS. 1 through 20C, so description will be omitted below. Control of negative pressure is performed by using water head pressure instead of providing a negative pressure control unit, as described later. The liquid discharge head 3 will be described as having two discharge orifice rows that discharge liquid of the same color, to facilitate description.

Figure 22:
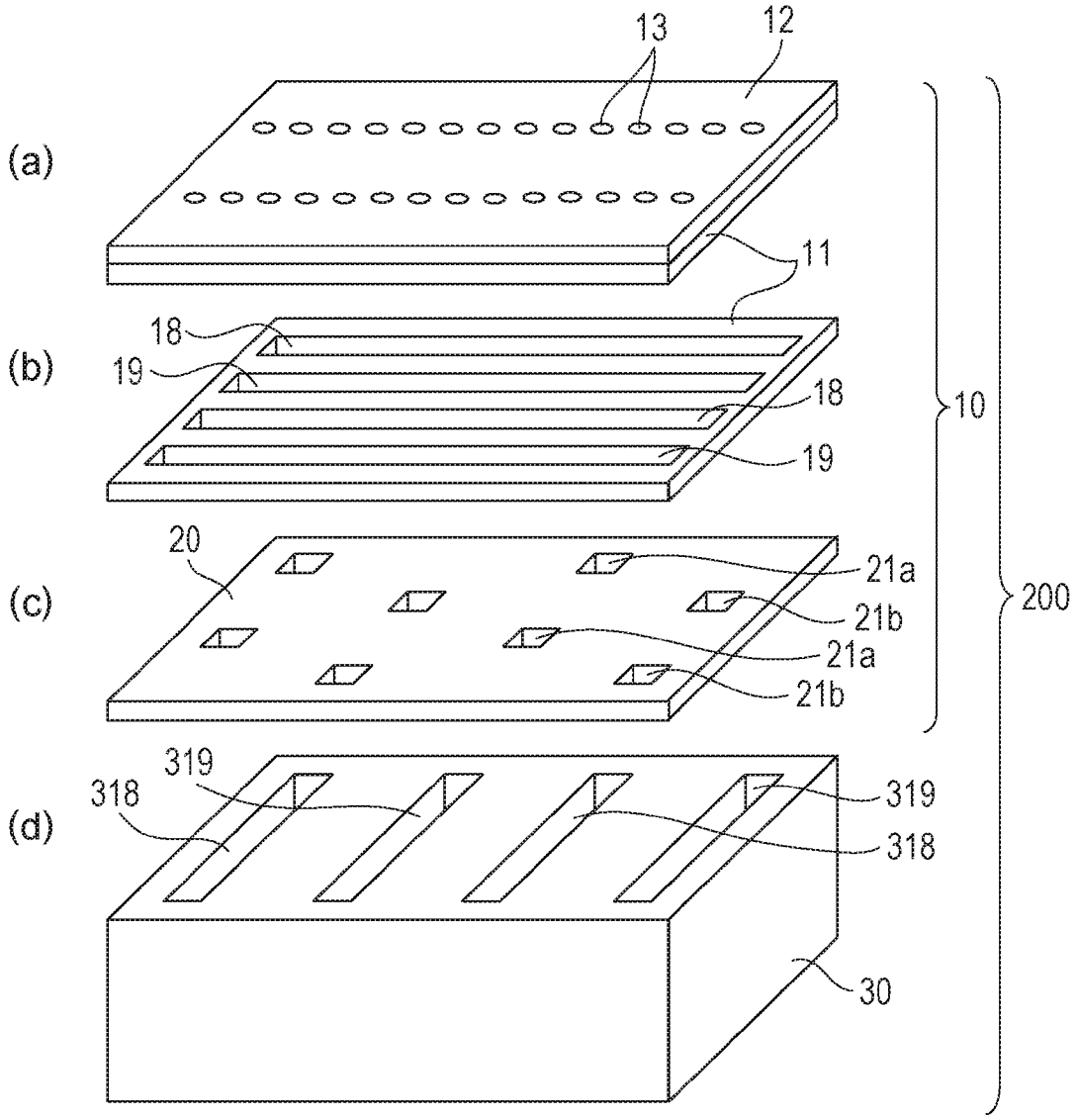
FIG. 22 is a perspective view of a discharge module.

In the liquid discharge unit 300 illustrated in FIG. 21, multiple support members 30 are joined to the channel member 210, and further, a recording element board 10 is joined for each support member 30, as described above. FIG. 22 is a disassembled perspective view illustrating the liquid discharge unit 300 in detail, illustrating a discharge module made up of the support member 30 and recording element board 10. FIG. 22 illustrates the substrate 11 making up the recording element board 10 divided in two, in the thickness direction thereof. One divided part is illustrated in a state joined to the discharge orifice forming member 12 in (a) in FIG. 22, and the other is illustrated in (b) in a state where liquid supply channels 18 and liquid recovery channels 19 are exposed. In FIG. 22, (c) illustrates the cover 20, and (d) illustrates the support member 30.

The support member 30 according to the present embodiment supports the recording element board 10 as to the channel member 210, and also functions to distribute liquid such as recording liquid from the channel member 210 to the recording element boards 10. The cover 20 is provided on the face of the recording element board 10 opposite to the face on which the discharge orifices 13 are formed, but in a case where the molding precision of the support member 30 is high, the cover 20 may be molded integrally with the support member 30. The cover 20 has multiple fine openings functioning to convert the pitch of the liquid channels from the support member 30 to the recording element boards 10. Of these openings, those openings that communicate with the liquid supply channel 18 will be referred to as supply-side openings 21*a*, and those openings that communicate with the liquid recovery channel 19 as recovery-side openings 21*b*. In the arrangement illustrated in FIG. 21, one channel member 210 is provided to all recording element boards 10 provided to the liquid discharge head 3, but an arrangement may be made wherein multiple channel members 210 are provided with each corresponding to multiple or one recording element board 10. Also, while a support member 30 is provided for each recording element board 10, one support member 30 may be provided for multiple recording element boards 10.

Slit-shaped supply-side distribution channels 318 and recovery-side distribution channels 319 are formed on the support member 30 in a direction orthogonal to the direction in which the discharge orifice rows extend. The distribution channels 318 and 319 correspond to the liquid communication ports 31 in the configurations illustrated in FIGS. 9B and 19B. The supply-side distribution channels 318 are paths that distribute and supply liquid from the common supply channel 211 within the channel member 210 to the recording element board 10, and communicate with the common supply channel 211. In the same way, the recovery-side distribution channels 319 are paths that recover liquid from the recording element board 10 to the common recovery channel 212 within the channel member 210, and communicate with the common recovery channel 212. The supply-side openings 21*a* provided in the cover 20 are provided at positions where the supply-side distribution channels 318 and liquid supply channel 18 intersect, so that these communicate. In the same way, the recovery-side openings 21*b* are provided at positions where the recovery-side distribution channels 319 and the liquid recovery channel 19 intersect, so that these communicate. The liquid supply channel 18 and liquid recovery channel 19 are formed as mutually parallel grooves extending in the direction in which the discharge orifice rows extend, on the face of the substrate 11 opposite to the face where the discharge orifices 13 are formed.

Figure 23A:
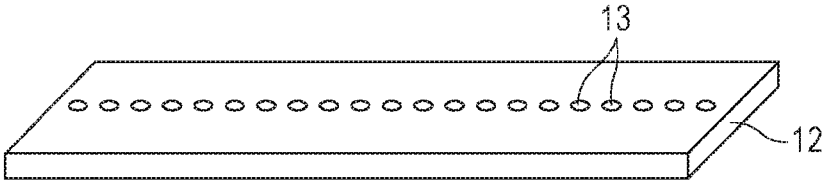
FIGS. 23A through 23C are disassembled perspective views of a recording element board.
Figure 23B:
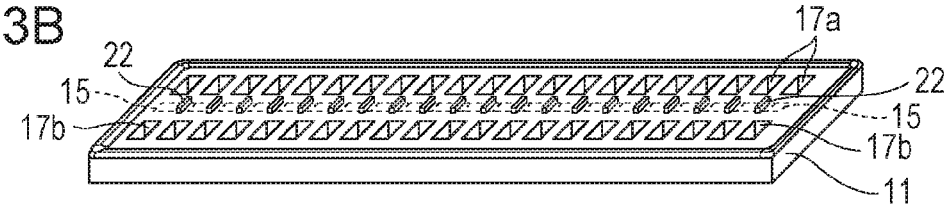
Figure 23C:
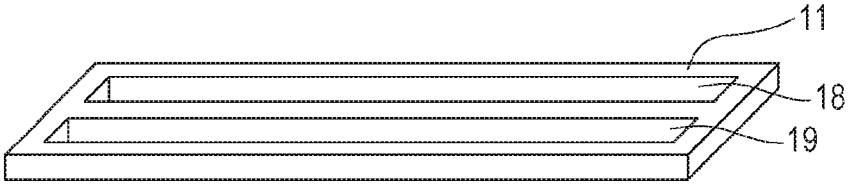
Figure 24A:
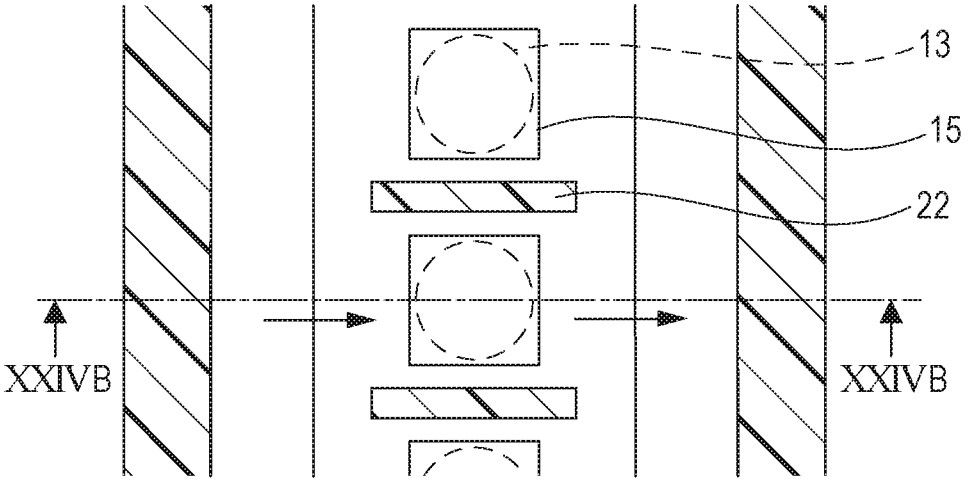
FIGS. 24A and 24B are diagrams for describing a pressure chamber and a discharge orifice in the recording element board.
Figure 24B:
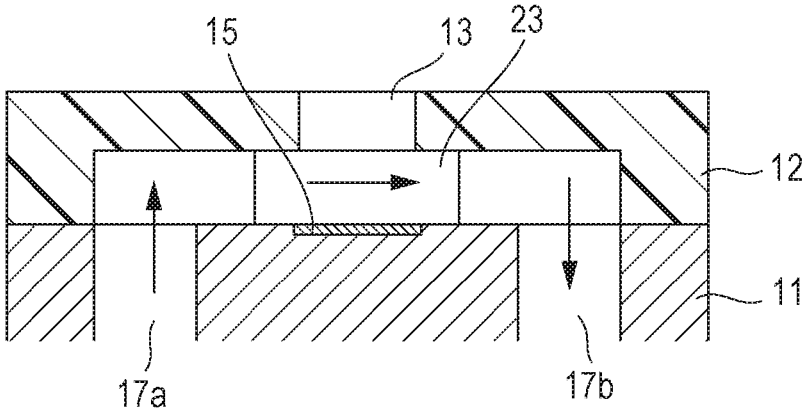

FIGS. 23A through 23C are disassembled perspective views describing the recording element board 10 in detail. FIG. 23A illustrates a portion where discharge orifices 13 are formed, FIG. 23B illustrates a portion where pressure chambers 23, supply ports 17*a*, and recovery ports 17*b* are formed, and FIG. 23C illustrates the substrate 11 where the liquid supply channel 18 and liquid recovery channel 19 are formed. Only one discharge orifice row is illustrated here for wake of description. FIGS. 24A and 24B are for describing a pressure chamber 23 and discharge orifice 13. FIG. 24A is a plan view illustrating a state of inside the recording element board 10 as viewed from the discharge orifice 13, and FIG. 24B is a cross-sectional view taken along line XXIVB-XXIVB in FIG. 24A. The liquid discharge head 3 according to the present embodiment will be described with reference to FIGS. 22 through 24B. A recording element 15 is provided on the surface of the substrate 11 so as to face the discharge orifices 13 as illustrated in FIGS. 23A through 24B, with the region between the discharge orifice 13 and recording element 15 being the pressure chamber 23. Although multiple recording elements 15 are provided on the substrate 11, partitions 22 are disposed between adjacent recording elements 15, partitioning off between pressure chambers 23. Accordingly, one recording element 15 and one discharge orifice 13 correspond to one pressure chamber 23. The supply ports 17*a* and recovery ports 17*b* respectively communicate with the liquid supply channel 18 and liquid recovery channel 19 formed as grooves on the opposite face of the substrate 11.

Multiple supply-side openings 21*a* communicating with the liquid supply channel 18 are formed on the cover 20 in a row, and multiple recovery-side openings 21*b* communicating with the liquid recovery channel 19 are formed on the cover 20 in a row, as illustrated in (c) FIG. 22. Slit-shaped supply-side distribution channels 318 and recovery-side distribution channels 319 are formed on the support member 30, communicating with the supply-side openings 21*a* and recovery-side openings 21*b*, respectively. These communicate with the common supply channel 211 and common recovery channel 212 formed on the channel member 210. In the following description the supply-side openings 21*a* of the cover 20 are also included in the supply-side distribution channels 318, and the recovery-side openings 21*b* are also included in the recovery-side distribution channels 319.

Figure 25:
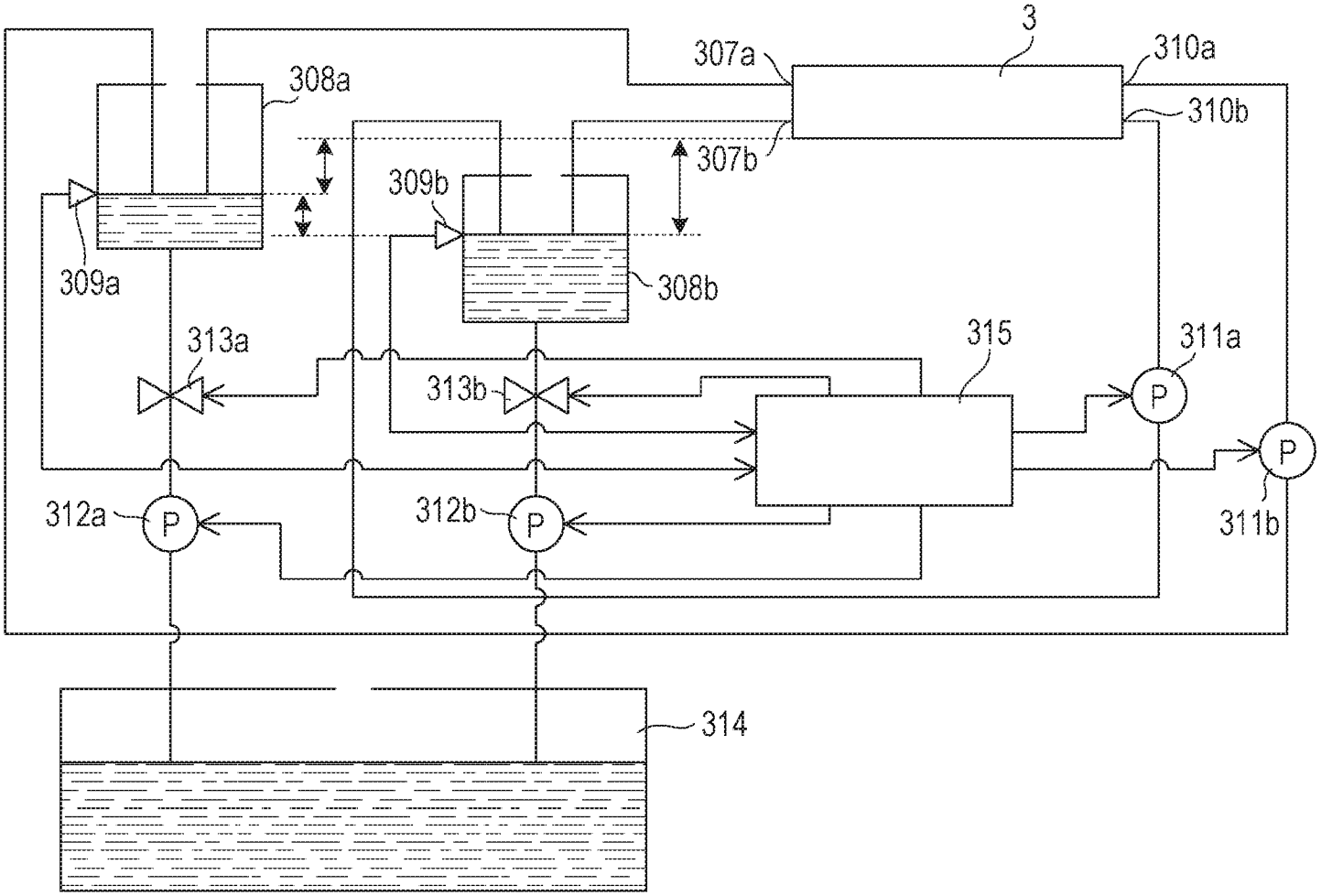
FIG. 25 is a diagram for describing a circulation arrangement in the liquid discharge apparatus.

The flow of liquid such as recording liquid at the liquid discharge head 3 according to the present embodiment will be described. Prior to describing the flow of liquid at the liquid discharge head 3, an overview of the configuration of the liquid discharge apparatus according to the present embodiment will be described with reference to FIG. 25. Provided to the liquid discharge head 3 are a high-pressure side inlet port 307*a* and outlet port 310*a*, and low-pressure side inlet port 307*b* and outlet port 310*b*. The common supply channel 211 is connected between the inlet port 307*a* and outlet port 310*a* in the liquid discharge head 3, and the common recovery channel 212 is connected between the inlet port 307*b* and outlet port 310*b*. The inlet ports 307*a* and 307*b* each are connected to buffer tanks 308*a* and 308*b* communicating with the atmosphere. On the other hand, the outlet port 310*a* and outlet port 310*b* each are connected to the buffer tanks 308*a* and 308*b* via constant flow pumps 311*a* and 311*b*. The buffer tanks 308*a* and 308*b* each function as storage units storing liquid (recording liquid in this case). Paths where liquid circulates are formed for each of the buffer tanks 308*a* and 308*b* in this liquid discharge apparatus, these paths being connected to the common supply channel 211 and common recovery channel 212, respectively, which will be described later. Accordingly, the path connecting to the common supply channel 211 will be referred to as a first circulation system, and the path connecting to the common recovery channel 212 will be referred to as a second circulation system.

A main tank 314 is provided to supply liquid to the buffer tanks 308*a* and 308*b*. A pump 312*a* and valve 313*a* are serially provided between the main tank 314 and buffer tank 308*a*, and a pump 312*b* and valve 313*b* are serially provided between the main tank 314 and buffer tank 308*b*. Liquid level sensors 309*a* and 309*b* are attached to the buffer tanks 308*a* and 308*b*, and a controller 315 controls pumps 312*a* and 312*b* and valves 313*a* and 313*b* based on sensor signals. The pressure difference between the inlet port 307*a* and inlet port 307*b* can be controlled to a desired value by control by the controller 315, and functions equivalent to the negative pressure control units 230 in the liquid discharge head 3 illustrated in FIGS. 1 through 20C can be realized. The pressure difference between the inlet port 307*a* and inlet port 307*b* is set such that the recording liquid flows through the pressure chambers 23 at a flow velocity of several mm/s to several tens of mm/s.

Figure 26A:
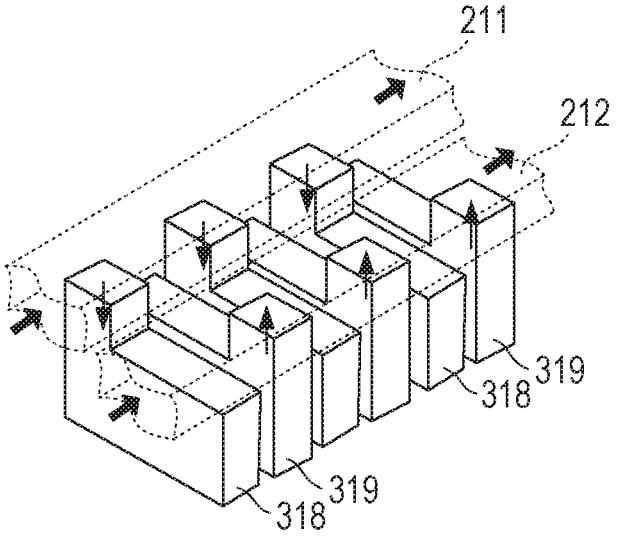
FIGS. 26A and 26B are diagrams for describing the flow of liquid.
Figure 26B:
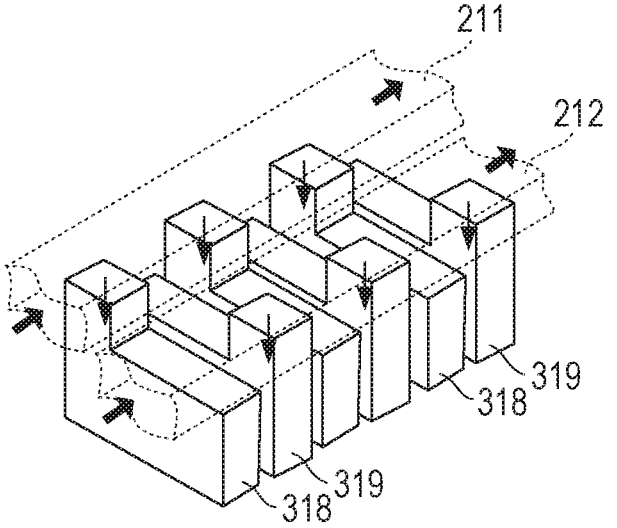

FIGS. 26A and 26B illustrate the flow of liquid in the common supply channel 211, common recovery channel 212, and the distribution channels 318 and 319, as viewed from the common supply channel 211 side and common recovery channel 212 side, by arrows. FIG. 26A shows that the flow of liquid flowing through the pressure chambers 23 flows from the common supply channel 211 through the supply-side distribution channels 318, circulates within the pressure chambers 23, and through the recovery-side distribution channels 319 to be expelled to the common recovery channel 212. In a recording state where the recording elements 15 are driven with the liquid being circulated to the pressure chambers 23 in this way, the flow of liquid heads from the supply ports 17*a* and recovery ports 17*b* toward the pressure chambers 23 for discharge from the discharge orifices 13, as illustrated in FIG. 26B. At this time, liquid that has passed through the pressure chambers 23 due to circulation and flowed out to the recovery-side distribution channels 319 flows toward the discharge orifices 13, and is discharged. Accordingly, the amount of liquid within the recovery-side distribution channels 319 decreases, but liquid is supplied from the common recovery channel 212 to the recovery-side distribution channels 319 to compensate for this phenomenon.

Now, the liquid discharge head 3 performs temperature control where the recording element boards 10 are warmed to a constant temperature, to suppress temperature change of the head due to driving, and maintain good recording quality. In a state where the temperature of the liquid discharge head 3 is raised and controlled, the liquid is warmed by flowing through the channels in the recording element boards 10, and warmed liquid flows into the recovery-side distribution channels 319. Once the liquid discharge head 3 enters recording operations, liquid that has been warmed during circulation is supplied from the recovery-side distribution channels 319 to the discharge orifices 13 as described above, so the temperature near the discharge orifices 13 rises. In a case where a state of continuously discharging is prolonged, the heated ink within the recovery-side distribution channels 319 is gradually discharged from the recording element boards 10 and unheated ink is supplied from the recovery-side distribution channels 319. Accordingly, the temperature of the liquid in the recovery-side distribution channels 319 decreases, and the temperature near the discharge orifices 13 also decreases, finally reaching a normal temperature.

In order to suppress this phenomenon, The flow resistance of the liquid recovery channels 19 formed as grooves in the substrates 11 of the recording element boards 10 is made to be larger than the flow resistance of the liquid supply channels 18. Now, the amount of liquid supplied to the pressure chambers 23 will be considered. In the following description, $R_{in}$ represents the composted flow resistance of the supply ports 17*a* and liquid supply channel 18, and $R_{out}$ represents the composited resistance of the recovery ports 17*b* and liquid recovery channel 19. Q represents the amount discharged in a full-discharge state where liquid is discharged from all discharge orifices 13, converted in to flow rate, and q represents the flow rate of the liquid circulating through the pressure chambers 23 when not discharging. Expression (1) below shows the flow rate $Q_{uota}$ of liquid supplied from the liquid recovery channel 19 to the pressure chambers 23 when the driving state of the liquid discharge head 3 changes from non-discharging to discharging.

$$Q_{out} = \frac{R_{in}}{R_{in} + R_{out}} \times Q - q \tag{1}$$

It can be seen from Expression (1) that if a configuration is made where the flow resistance of the liquid recovery channel 19 is larger than the flow resistance of the liquid supply channel 18, the amount of liquid supplied from the liquid recovery channel 19 to the pressure chambers 23 when discharging decreases. Accordingly, the backflow of liquid within the liquid recovery channel 19 accompanying change in the driving state of the liquid discharge head 3 can be reduced, a state where the temperature of liquid within the pressure chambers 23 temporarily becomes excessively high can be suppressed, and recording quality can be maintained at a high level. The flow resistance of the liquid recovery channel 19 can be set higher than the flow resistance of the liquid supply channel 18 by making the cross-sectional area of a plane perpendicular to the flow direction of liquid in the liquid supply channel 18 to be larger than the cross-sectional area of a plane perpendicular to the flow direction of liquid in the liquid recovery channel 19, for example.

Figure 27:
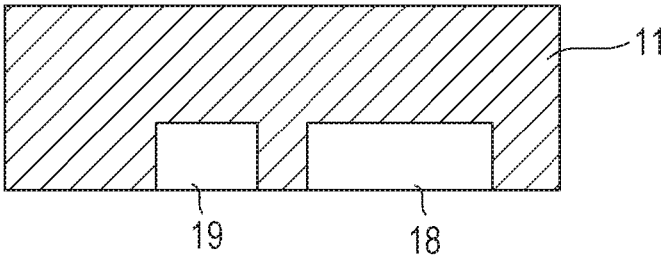
FIG. 27 is a schematic cross-sectional view illustrating a substrate main unit according to a first example.
Figure 28:
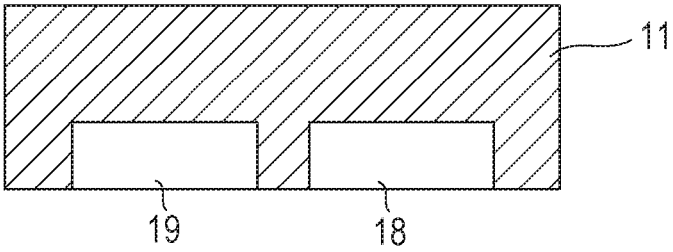
FIG. 28 is a schematic cross-sectional view illustrating a substrate main unit according to a first comparative example.

The following is a description of the liquid discharge head 3 according to the present embodiment, based on several examples and comparative examples. FIG. 27 schematically illustrates a cross-section of the substrate 11 of the recording element board 10 orthogonal the flow direction of the liquid supply channel 18, in a first example. FIG. 28 schematically illustrates the cross-section of the recording element board 10 as a first comparative example.

First Example and First Comparative Example

A recording element board 10 where the cross-sectional area of the liquid recovery channel 19 is one-third the cross-sectional area of the liquid supply channel 18 was fabricated, by changing the width of the channels, as illustrated in FIG. 27, as a first example. Thus, the composited flow resistance of the recovery ports 17*b* and liquid recovery channel 19 is four times as compared to the composited flow resistance of the supply ports 17*a* and liquid supply channel 18.

As a first comparative example, a recording element board 10 was fabricated where the cross-sectional area of the liquid recovery channel 19 and the liquid supply channel 18 were the same, by making the width and depth of the channels to be the same, as illustrated in FIG. 28.

Figure 29:
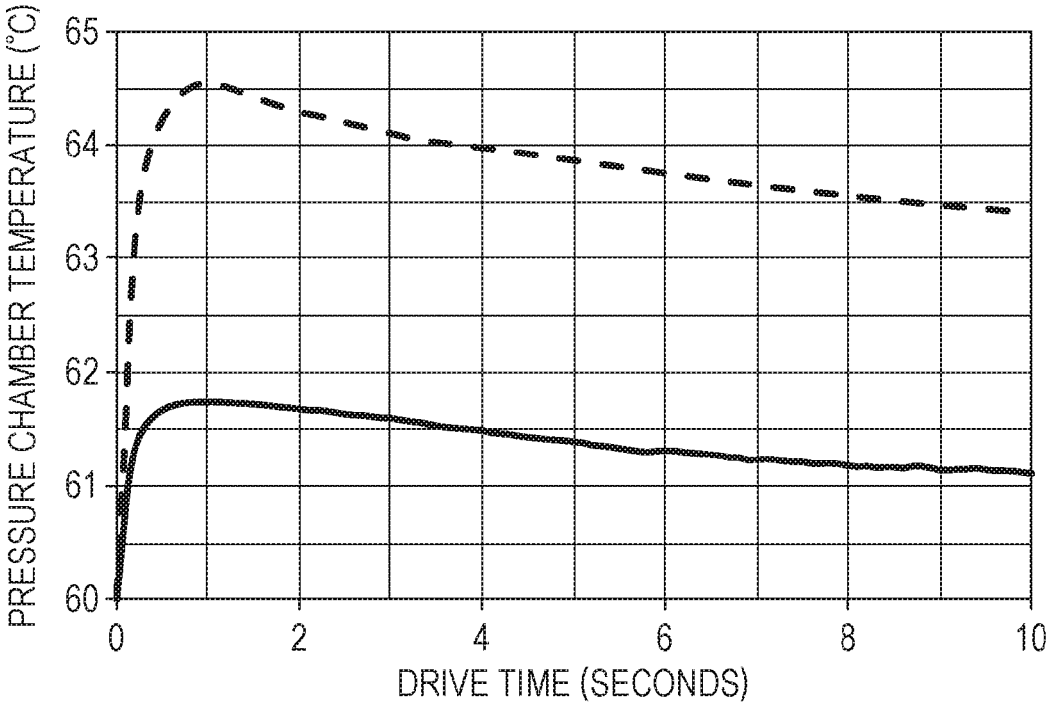
FIG. 29 is a diagram illustrating change on pressure chamber temperature over time.

The pressure difference between the buffer tanks 308*a* and 308*b* was set to around 300 Pa, so that the liquid would flow at a flow velocity of 10 mm/s through the pressure chambers 23 that were 30 μm wide and 15 μm high. Recording liquid for inkjet recording was used as the liquid supplied to the liquid discharge head 3. The temperature of the supplied recording liquid was controlled to 35° C., temperature control was performed for the recording element board 10 so that the temperature sensors (omitted from illustration) disposed near the pressure chambers 23 all read 60° C., and the temperature distribution at the liquid discharge head 3 was brought to a state of equilibrium. In this state of equilibrium, the liquid discharge heads 3 according to the first example and first comparative example were driven at a driving frequency of 8000 Hz for a discharge amount of $5\times10^{-15}$ $m^3$, and temporal change of the average temperature of recording liquid within the pressure chambers 23 was calculated. The results are shown in FIG. 29, where the solid line represents the first example, and the dotted line represents the first comparative example.

In the first comparative example, around recording liquid of about four times the amount of recording liquid circulating due to pressure difference is discharged, so hot recording liquid in the liquid recovery channel 19 backs up into the pressure chambers 23, and so the temperature within the pressure chambers 23 temporarily becomes excessively high. On the other hand, the composited flow resistance of the recovery ports 17*b* and liquid recovery channel 19 is around four times the composted flow resistance of the supply ports 17*a* and liquid supply channel 18, so the flow rate of hot recording liquid backing up from the liquid recovery channel 19 is reduced to around two fifths, from Expression (1). Accordingly, the first example suppresses temperature rise of the recording liquid within the pressure chambers 23 as compared to the first comparative example.

Thus, changing the shape of the liquid recovery channel 19 formed in the substrate 11 so as to increase the flow resistance enables the temperature rise of liquid in the pressure chambers 23 to be suppressed, so a liquid discharge head 3 with high recording quality can be fabricated. In the present embodiment, the flow resistance of the liquid recovery channel 19 was made to be around four times that of the liquid supply channel 18, but the present invention is not restricted to this, and it is sufficient as long as the relationship is satisfied where the composited flow resistance of the recovery ports and the liquid recovery channel is larger than the composited flow resistance of the supply ports and the liquid supply channel.

Second Example

The second example takes note of the relationship between the composited flow resistance of the supply ports 17*a* and liquid supply channel 18, the composited flow resistance of the recovery ports 17*b* and the liquid recovery channel 19, the discharge amount Q, and the flow rate q of liquid circulating the through the pressure chambers 23 when not discharging. The flow rate of hot liquid backing up from the liquid recovery channel 19 is markedly reduced by these flows satisfying a later-described Expression (4). Note that the discharge amount Q here indicates the total sum of droplet amounts of droplets discharged from all discharge orifices 13 included in the liquid discharge head 3.

Based on Expression (1), the conditions for the flow rate of liquid supplied from the liquid recovery channel 19 to the pressure chambers 23 at the time of discharge to become substantially zero, i.e., the conditions for no backflow, are as in the following Expression (2).

$$q > \frac{R_{in}}{R_{in} + R_{out}} \times Q \tag{2}$$

However, in a situation where more liquid circulates through the pressure chambers 23 when not discharging, than the amount of liquid discharged, there are cases where imbalance in pressure distribution in the channels increases due to pressure drop, leading to unevenness in discharge properties. Accordingly, the circulation amount of liquid needs to be smaller than the flow rate of liquid that is discharged, as illustrated in Expression (3) below.

$$q<Q \tag{3}$$

Accordingly, it can be seen from Expressions (2) and (3) that the following Expression (4) heeds to hold as conditions for avoiding unevenness in discharge properties due to pressure drop, while markedly reducing the flow rate of hot liquid backing up from the liquid recovery channel 19.

$$Q > q > \frac{R_{in}}{R_{in} + R_{out}} \times Q \tag{4}$$

Figure 30:
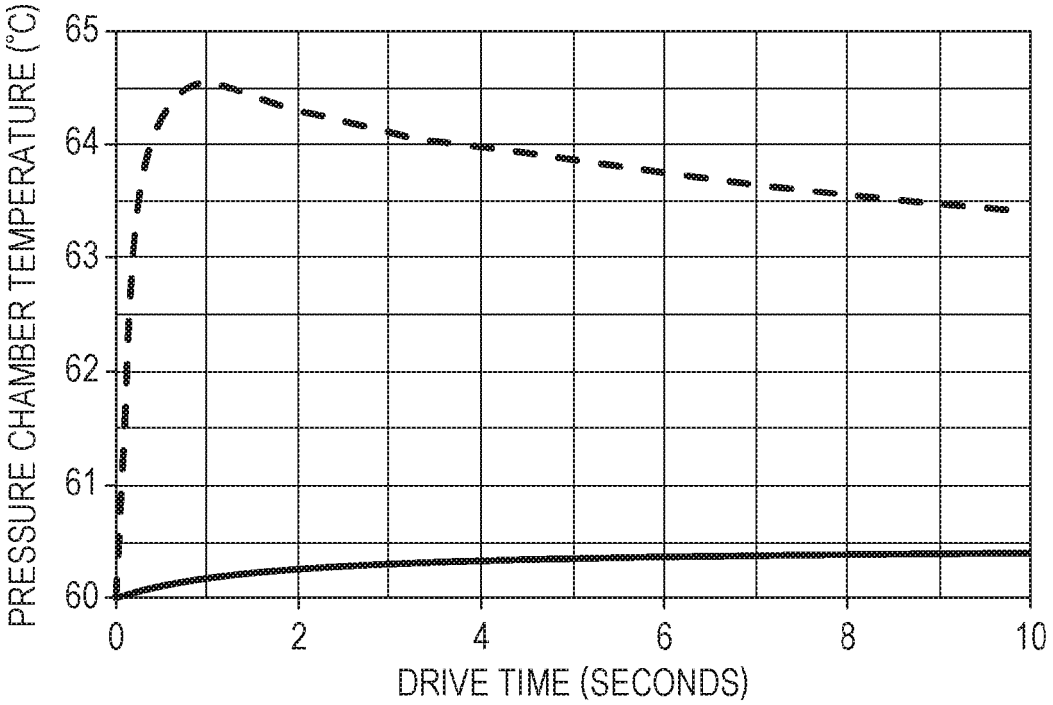
FIG. 30 is a diagram illustrating change on pressure chamber temperature over time.

In the second embodiment, a liquid discharge unit 300 the same as the first embodiment illustrated in FIG. 27 was used. The flow velocity within the pressure chambers 23 was set to 60 mm/s to satisfy the conditions of Expression (4), and the pressure difference between the buffer tanks 308*a* and 308*b* was set to around 1800 Pa to achieve this flow velocity. In the state of equilibrium under the same conditions as in the first example, the liquid discharge heads 3 according to the second example and first comparative example were driven at a driving frequency of 8000 Hz for a discharge amount of $5\times10^{-15}$ $m^3$, and temporal change of the average temperature of recording liquid within the pressure chambers 23 was calculated. The results are shown in FIG. 30, where the solid line represents the second example, and the dotted line represents the first comparative example.

In the second example, the flow rate of liquid circulating through the pressure chambers 23 when not discharging satisfies the conditions of Expression (4), so there is hardly any hot liquid backing up from the liquid recovery channel 19. On the other hand, in the first comparative example, the flow rate q of liquid circulating through the pressure chambers 23 when not discharging is around half the value at the right side in Expression (4), so the conditions of Expression (4) are not satisfied. It can be seen from FIG. 30 the second example suppresses temperature rise within the pressure chambers 23 in comparison with the first comparative example, and further in comparison with the first example as well. Accordingly, a liquid discharge head with high recording quality can be fabricated.

Although water head difference has been described as being used in the present embodiment to generate negative pressure between the high-pressure side and low-pressure side, arrangements for generating and controlling negative pressure are not restricted to this. A negative pressure control unit such as illustrated in FIGS. 1 through 20C may be used. Also, though an arrangement has been described where temperature near the pressure chambers 23 is monitor to suppress change in discharge properties due to temperature change in the pressure chambers 23, thereby maintaining the temperature of the liquid within the pressure chamber 23 within a set range, the present invention is effective in cases of using other heating arrangements, as well.

According to the present invention, a liquid discharge head and a liquid discharge apparatus using the liquid discharge head, can be provided, whereby liquid circulation to pressure chambers can be realized without causing variation in discharge properties, and excessive rise in temperature due to backflow of hot liquid to the pressure chambers is suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-002946, filed Jan. 8, 2016 and No. 2016-236072 filed Dec. 5, 2016, which are hereby incorporated by reference herein in their entirety.

What is claimed is:

1. A liquid discharge head comprising:

a plurality of recording elements configured to generate energy to discharge liquid;

a recording element board having a first face on which the plurality of recording elements are provided;

discharge orifices configured to discharge liquid; and pressure chambers containing the recording elements within;

wherein the recording element board has a liquid supply channel communicating with the plurality of pressure chambers, formed on a second face that is an opposite side from the first face, a liquid recovery channel communicating with the plurality of pressure chambers, formed on the second face, supply ports communicating with the pressure chambers and the liquid supply channel, and recovery ports communicating with the pressure chambers and the liquid recovery channel, wherein a flow of the liquid is from the liquid supply channel to the supply ports, pressure chambers, and the recovery ports, in that order, unto the liquid recovery channel, and wherein a composited flow resistance of the liquid recovery channel and recovery ports is greater than a composited flow resistance of the liquid supply channel and supply ports.

2. A liquid discharge head according to claim 1, wherein a cross-sectional area of the liquid supply channel at a plane perpendicular to the direction of flow of liquid is larger than a cross-sectional area of the liquid recovery channel at a plane perpendicular to the direction of flow of liquid.

3. A liquid discharge head according to claim 1, wherein $$Q > q > \frac{R_{in}}{R_{in} + R_{out}} \times Q$$

holds, where Q represents the flow rate of liquid discharged when liquid is discharged from all discharge orifices communicating with the liquid supply channel, q represents the flow rate of liquid flowing from the supply ports through the pressure chambers and to the recovery ports in a standby state where discharge of the liquid is not performed, $R_{in}$ represents a composited flow resistance of the liquid supply channel and supply ports, and $R_{out}$ represents a composited flow resistance of the liquid recovery channel and recovery ports.

4. A liquid discharge head according to claim 1, further comprising:

a channel member where a plurality of the recording element boards are arrayed, wherein the channel member includes a common supply channel communicating with the liquid supply channel, and a common recovery channel communicating with the liquid recovery channel.

5. A liquid discharge head according to claim 4, wherein part of the liquid in the common supply channel passes from the liquid supply channel through the pressure chambers and reaches the liquid recovery channel and flows to the common recovery channel, in accordance with a pressure difference between the common supply channel and the common recovery channel.

6. A liquid discharge head according to claim 1, wherein the liquid supply channel and the liquid recovery channel extend in a direction following the first face, and the supply ports and recovery ports extend in a direction intersecting the first face.

7. A liquid discharge head according to claim 1, wherein a plurality of supply ports communicate with the liquid supply channel, and a plurality of recovery ports communicate with the liquid recovery channel.

8. A liquid discharge head according to claim 1, wherein a cover making up part of the liquid supply channel and the liquid recovery channel is provided to the second face of the recording element board.

9. A liquid discharge head according to claim 8, wherein the cover includes supply-side openings communicating with the liquid supply channel, and recovery-side openings communicating with the liquid recovery channel.

10. A liquid discharge head according to claim 8, wherein the cover is configured of a resin film.

11. A liquid discharge head according to claim 1, wherein the recording element board includes a discharge orifice forming member having the discharge orifices, and a substrate having the recording elements.

12. A liquid discharge head according to claim 1, wherein the liquid within the pressure chambers is circulated between the inside of the pressure chambers and the outside of the pressure chambers.

13. A liquid discharge apparatus comprising:

a liquid discharge head including a recording element board having a first face on which a plurality of recording elements configured to generate energy to discharge liquid is provided, discharge orifices configured to discharge liquid, pressure chambers having the recording elements within, a liquid supply channel communicating with the plurality of pressure chambers, formed on a second face that is an opposite side from the first face, a liquid recovery channel communicating with the plurality of pressure chambers, formed on the second face, supply ports communicating with the pressure chambers and the liquid supply channel, and recovery ports communicating with the pressure chambers and the liquid recovery channel;

a storage unit configured to store liquid; and a liquid transfer unit configured to supply and recover liquid between the storage unit and the liquid discharge head, wherein a flow of the liquid is from the liquid supply channel to the supply ports, pressure chambers, and the recovery ports, in that order, unto the liquid recovery channel, and a composited flow resistance of the liquid recovery channel and recovery ports is greater than a composited flow resistance of the liquid supply channel and supply ports.

* * * * *